US005781885A

United States Patent [19]

Inoue et al.

[11] Patent Number: 5,781,885

[45] Date of Patent: Jul. 14, 1998

[54] COMPRESSION/EXPANSION METHOD OF TIME-SCALE OF SOUND SIGNAL

[75] Inventors: Takeo Inoue; Shozo Sugishita, both of Osaka, Japan

[73] Assignee: Sanyo Electric Co., Ltd., Osaka, Japan

[21] Appl. No.: 888,527

[22] Filed: Jul. 7, 1997

Related U.S. Application Data

[63] Continuation of Ser. No. 303,349, Sep. 9, 1994, abandoned.

[30] Foreign Application Priority Data

| | | | |
|---|---|---|---|
| Sep. 9, 1993 | [JP] | Japan | 5-224451 |
| Dec. 24, 1993 | [JP] | Japan | 5-327898 |
| May 10, 1994 | [JP] | Japan | 6-096530 |

[51] Int. Cl.[6] ..... G10L 5/02

[52] U.S. Cl. ..... 704/267; 704/500

[58] Field of Search ..... 360/8, 32; 704/211, 704/200, 258, 267, 500–504

[56] References Cited

U.S. PATENT DOCUMENTS

| | | | |
|---|---|---|---|
| 4,631,746 | 12/1986 | Bergeron et al. | 395/2.26 |
| 4,890,325 | 12/1989 | Taniguchi et al. | 381/34 |

*Primary Examiner*—Kee M. Tung
*Attorney, Agent, or Firm*—Darby & Darby

[57] ABSTRACT

At a time of compression, two sound waveform segments each having single pitch length are cut-out from an input sound waveform at a time point represented by a current pointer and at a time point advanced from the time point by a single pitch period, respectively, and then, by adding the two sound waveform segments to each other after being multiplied by window functions, a single sound waveformn segment being compressed is produced. Next, the pointer is moved on the input sound waveform according to a compression rate, and then, a similar operation is repeated to produce a sound signal being compressed. At a time of expansion, two sound waveform segments each having double pitch length are cut-out from the sound waveform thus compressed at a time point represented by the current pointer and at a time point delayed from the time point by the single pitch period, respectively, and then, by adding the two sound wave segments to each other after being multiplied by window functions, a single synthesized sound wave form segment is obtained. Next, the pointer is moved on the sound waveform being compressed according to an expansion rate, and then, by repeating a similar operation, a sound signal being expanded is obtained.

7 Claims, 20 Drawing Sheets

COMPRESSION/EXPANSION METHOD OF TIME-SCALE OF SOUND SIGNAL

This is a continuation of application Ser. No. 08/303,349, filed Sep. 9, 1994 now abandoned.

BACKGROUND OF THE INVENTION

1. Field of the Invention

The present invention generally relates to a compression/expansion method of a time-scale of a sound signal. More specifically, the present invention relates to a compression/expansion method in which a time-scale of a digital sound signal is compressed or expanded in such a case where a sound signal is recorded or reproduced on or from a magnetic tape in a VTR, for example, or a case where a sound signal is recorded or reproduced in or from in an IC memory In a telephone answering machine, for example.

2. Description of the Prior Art

In a method for compressing/expanding a time-scale of a digital sound signal, in general, after two sound waveform segments are cut-out from the digital sound signal, the two sound waveform segments are added to each other after being multiplied by weights different from each other, whereby a single synthesized sound waveform segment is produced.

As one example, a TDHS (Time Domain Harmonic Scaling) system disclosed in IEEE Trans. Speech, Signal Processing, vol. ASSP27, pp. 121–133, April '79 "Time Domain Algorithm for Harmonic Band Width Reduction and Time Scaling of Speech Signals" by D. Malah is known.

In a case where a time-scale of a digital sound signal is compressed by utilizing the TDHS system, on the assumption that a pitch period of the digital sound signal is T, and a compression rate is rc ($0<rc<1$), as shown in FIG. 1(*a*), two sound waveform segments A and B each having a length of Nc given by the following equation (1) are cut-out at & time point P1 represented by a current pointer and at a time point P2 advanced from the time point P1 by a single pitch period T, respectively.

$$Nc=rc\cdot T/(1-rc) \quad (1)$$

A weight that is linearly changed from 1 to 0, i.e., a window function F1 shown by a dotted line in Figure 1(*a*) and a weight that is linearly changed from 0 to 1, i.e., a window function F2 shown by a dotted line in FIG. 1(*a*) are applied to the sound waveform segments A and B, respectively, and then, by adding the both sound waveform segments A and B to each other, a sound waveform segment C having a length of Nc is newly obtained as shown in FIG. 1(*b*). Accordingly, the time-scale of the sound signal becomes to be compressed.

In order to compress the time-scale of the sound signal succeeding to the sound waveform segment B, a time point P3 is designated by moving the pointer toward right on an input sound signal (FIG. 1(*a*)) by "Nc+T" given by the following equation (2), and then, as similar to the above described method, two sound waveform segments each having the length of Nc are cut-out, and thereafter, by adding the two sound waveform segments to each other after the weights F1 and F2 are applied thereto, a new sound waveform segment having the length of Nc is further obtained, by which the sound waveform segment C of FIG. 1(*b*) is followed.

$$Nc+T=T/(1-rc) \quad (2)$$

Thereafter, by repeating such operations, an output sound waveform segments each having the length of Nc are continuously produced from the input sound waveform segments each having the length of "Nc+T". At this time, the output sound waveform segment of the length of Nc becomes a waveform segment that the input sound waveform segment having the length of "Nc+T" is compressed with the compression rate rc.

On the other hand, in a case where a sound waveform is expanded with an expansion rate rs ($rs>1$), as shown in FIG. 2(*a*), two sound waveform segments A and B each having a length of Ns given by the following equation (3) are cut-out at a time point P1 represented by a current pointer and at a time point P4 delayed from the time point P1 by the single pitch period T, respectively.

$$Ns=rs\cdot T/(rs-1) \quad (3)$$

At this time, a position advanced from the time point P4 by a length of Ns becomes a time point P6.

Next, a weight that is linearly changed from 0 to 1, i.e., a window function F3 shown by a dotted line in FIG. 2(*a*) and a weight that is linearly changed from 1 to 0, i.e., a window function F4 shown by a dotted line in FIG. 2(*a*) are applied to the sound waveform segments A and B, respectively, and then, by adding the both sound waveform segments A and B to each other, a sound waveform segment C having the length of Ns is obtained as shown in FIG. 2(*b*). Accordingly, the time-scale of the sound signal becomes to be expanded.

In order to expand the time-scale of the sound signal succeeding to the time point P6, the pointer is moved toward right on an input sound waveform (FIG. 2(*a*)) by "Ns–T" given by the following equation (4), and then, as similar to the above described method, two sound waveform segments each having the length of Ns are cut-out, and thereafter, by adding the two sound waveform segments to each other after the weights F3 and F4 are applied thereto, a new sound waveform segment having the length of Ns is further obtained, by which the sound waveform segment C is followed.

$$Ns-T=T/(rs-1) \quad (4)$$

Thereafter, by repeating such operations, an output sound waveform segments each having the length of Nc are continuously produced from the input sound waveform segments each having the length of "Ns–T". At this time, the output sound waveform segment of the length of Ns becomes a waveform segment that the input sound waveform segment having the length of "Ns–T" is expanded with the expansion rate rs.

However, the pitch period of an actual sound signal is not constant, and therefore, if the above described TDHS system is applied to the compression/expansion of the time-scale of the sound signal in such a case, when the compression rate rc or the expansion rate rs is close to 1, the length Nc or Ns evaluated according to the equation (1) or (3) becomes too large with respect to the pitch period T. Specifically, if $rc=0.99$ is utilized in the-equation (1), the length Nc becomes 99T ($Nc=99T$), and if $rs=1.01$ is utilized in the equation (3), the length Ns becomes 101T ($Ns=101T$).

Therefore, in the TDHS system, though the pitch period of the actual sound signal is not constant, the compression/expansion process is performed while the pitch period T of the sound waveform is regarded as constant within the length Nc or Ns, and therefore, within the length Nc or Ns shown in FIG. 1 (*a*) or FIG. 2(*a*), a deviation of a waveform due to a fluctuation of the pitch period occurs in the actual sound signal, and accordingly, there was a problem that a distortion occurs in a sound waveform after compression/expansion.

Furthermore, as another example, a PICOLA (Pointer Interval Control Overlap and Add) system disclosed in IECE (The Institute of Electronics and Communication Engineers of Japan) Technical Report, Vol. 86, No. 25 EA86-5, pp. 9–16, 1986.5.21, "Time-Scale Modification Algorithm for Speech by use of Autocorrelation Method and Its Evaluation", by Naotaka Morita and Fumitada Itakura is known. In the PICOLA system, a time-scale of a sound signal is compressed in accordance with a flowchart shown in FIG. 3.

In a step S1 of FIG. 3, a compression rate rc is designated or set. Specifically, the compression rate rc is set in advance, or inputted as necessary. In a next step S2, a pitch period T of an input sound waveform is calculated, and a length Lc of a waveform segment is calculated on the basis of a following equation (5) by utilizing the pitch period T.

$$Lc=rc\cdot T/(1-rc) \tag{5}$$

In addition, in order to evaluate the pitch period T, at first, in a step S21 shown in FIG. 4, a window length N necessary for calculating an autocorrelation value is set. Next, in a step S22, N sound data segments are derived. For example, when a sampling frequency of an A/D converter (not shown) is 8 kHz, the segments at a degree of 400 samples (N=400) are derived. In a step S23, according to the following equation (6), a short-time autocorrelation value is calculated.

$$Rn(k)=\sum_{m=0}^{N-1-k}[x(n+m)w(m)][x(n+m+k)w(k+m)] \tag{6}$$

In a step S24, a time delay by which the short-time autocorrelation value calculated in the step S23 becomes maximum is made as a pitch period T. Then, in a step 825, it is determined whether or not the sound data more than N (400, for example) remain, and if "YES", the process returns to the previous step S22, and therefore, the steps S22–S24 are repeatedly executed.

In addition, the above described method for evaluating a pitch period is described in detail in "Digital Processing of Speech Signals (first volume) (second volume)", by R. Raibiner and R. W. Schafer, and translated by Hisayoshi Suzuki, published by Corona. However, as a method for evaluating a pitch period, other arbitrary method may be utilized.

Turning back to FIG. 3, In a step S3, it is determined whether or not the compression rate rc designated in the step S1 is equal to ½ (50%) or larger than ½. In this prior art, dependent on a magnitude of the compression rate rc, the sound waveform is processed in manners different from each other. Therefore, if "YES" is determined in the step S3, in order to process the sound waveform according to FIG. 5, the process proceeds to a step S4, and if "NO" is determined in the step S3, the process proceeds to a step S9 such that the sound waveform is processed according to FIG. 6.

In a step S4, as shown in FIG. 5(*a*), waveform 15 segments B and C each having a length of T are cut-out at a time point P1 represented by a current pointer and a time point P2 advanced from the time point P1 by the single pitch period T, respectively. In a next step S5, a weight that is linearly changed from 1 to 0, i.e., a window function $W1=1-i/(T-1)$ ($i=0, 1, \ldots, T-1$) is multiplied by the sound waveform segment B, and a weight that is linearly changed from 0 to 1, i.e., a window function $W2=i/(T-1)$ is multiplied by the sound waveform segment C, and then, by adding the two sound waveform segments to each other, a sound waveform segment E having a length of T is produced. In a step S6, the pointer is moved to a time point P4 advanced from the time point P1 by "T+Lc" on an input sound waveform. In a step S7, the input waveform segment of a length of "Lc–T" from a time point P3 to the time point P4 is outputted as a sound waveform segment by which the sound waveform segment E is followed. In a step S8, it is determined whether or not the compression process is to be continued, and if "YES" is determined, the process returns to the step S2, and if "NO" is determined, the process is terminated.

When "NO" is determined in the step 53, the process proceeds to the step S9; however, since the steps S9 and S10 are basically the same as the steps S4 and S5, respectively, a duplicate description will be omitted here.

Then, in a step S11, as shown in FIG. 6(*a*) and FIG. 6(*b*), a sound waveform segment of a portion having a length of Lc from a head of the sound waveform segment E produced in the step S10 is outputted. In a step S12, a waveform segment of a portion of "T–Lc" after the time point P6 of the sound waveform segment E is returned to the input. The pointer is moved from the time point P1 to a time point P5 in a step S13, and thereafter, the process proceeds to the step S8.

Thus, at a time of rc≧½, the pointer is moved to the time point PS advanced from the time point P1 by "T+Lc" on the input sound waveform shown in FIG. 6(*a*), and then, only the sound waveform segment of the portion with the length Lc from the head of the sound waveform segment E is outputted., and the sound waveform segment of the portion of "T–Lc" is returned to the input 60 as to be utilized again for a succeeding process. A reason why the sound waveform segment of the portion of "T–Lc" is returned to the input is to keep a continuity at the time point P6 of the output waveform segment E because the compression process performed in FIG. 6(*a*) is aimed at the input sound waveform after the time point P5.

Thus, in the PICOLA system, the time-scale of the sound signal is compressed with the compression rate rc.

Furthermore, in order to expand the time-scale of the input sound signal in the PICOLA system, the sound signal data is processed in accordance with a flowchart shown in FIG. 7.

More specifically, in a step S31 of FIG. 7, an expansion rate rs is designated or set. Specifically, the expansion rate rs may be set as a reciprocal of the compression rate rc. In a next step S32, a pitch period T of an input sound waveform is calculated, and a length Ls of a waveform segment is calculated on the basis of a following equation (7) by utilizing the pitch period T.

$$Ls=T/(rs-1) \tag{7}$$

In a step S33, it is determined whether or not the expansion rate rs designated in the step S31 is equal to 2 (200%) or smaller than 2. If "YES" is determined, that is, rs≦2 is determined in the step S33, in order to process the sound waveform according to FIG. 8, the process proceeds to a step S34, and if "NO" is determined, that is, rs>2 is determined in the step S33, the process proceeds to a step S41 such that the sound waveform is processed according to FIG. 9.

In a step S34, a sound waveform segment A having a length T from a time point T represented by a current pointer is outputted as it is from the input sound waveform. Next, in a step S35, as shown In FIG. 8(*a*), waveform segments E and F each having a length of T are cut-out at a time point P1 represented by the current pointer and a time point P2 advanced from the time point P1 by the single pitch period T, respectively. In a next step S36, a weight that is linearly changed from 0 to 1, i.e., a window function W3=i/(T−1) (i=0, 1, . . . , T−1) is multiplied by the sound waveform segment E, and a weight that is linearly changed from 1 to 0, i.e., a window function W4=1−i/(T−1) is multiplied by the sound waveform segment F, and then, by adding the two sound waveform segments to each other, a sound waveform segment J having a length of T is produced. In a step S37, the sound waveform segment J is outputted so as to follow the sound waveform E. In a next step S38, the pointer is moved to a time point P5 advanced from the time point P1 by "Ls−T" on an input sound waveform. In a step S39, the input waveform segment of a length of "Ls−T" from a time point P2 is outputted as a sound waveform segment by which the sound waveform segment J is followed. In a step S40, it is determined whether or not the expansion process is to be continued, and if "YES" is determined, the process returns to the step S32, and if "NO" is determined, the process is terminated.

When "No" is determined In the step S33, the process proceeds to the step S41; however, since the steps S41, S42 and S43 are basically the same as the steps S34, S35 and S36, respectively, a duplicate description will be omitted here.

Then, in a step S44, as shown in FIG. 9(*a*) and FIG. 9(*b*), a sound waveform segment of a portion having a length of "Ls" from a head of the sound waveform segment J produced in the step S43 is outputted. In a step S45, a waveform segment of a portion of "T-Ls" after a time point P7 of the sound waveform segment J is returned to the input. The pointer is moved from the time point P1 to a time point P6 in a step S46, and thereafter, the process proceeds to the step S40.

Thus, at a time of rs≦2, the pointer is moved to the time point P6 advanced from the time point P1 by "Ls" on the input sound waveform shown in FIG. 9(*a*), and then, only the sound waveform segment of the portion with the length Ls from the head of the sound waveform segment J is outputted, and the sound waveform segment of the portion of "T−Ls" is returned to the input so as to be utilized again for a succeeding process. A reason why the sound waveform segment of the portion of "T−Ls" is returned to the input is to keep a continuity at the time point P7 of the output waveform segment J because the expansion process performed in FIG. 9(*a*) is aimed at the input sound waveform after the time point P6.

In the above described manner, the PICOLA system can be utilized for the compression/expansion of the time-scale of the sound signal, and the sound signal shown in FIG. 5(*a*) becomes the sound signal shown in FIG. 8(*b*). As seen from comparison of FIG. 5(*a*) and FIG. 8(*b*), if the sound signal is compressed/expanded by the PICOLA system, there was a problem that the sound waveform segment after compression/expansion becomes to be distorted as a whole. More specifically, as the waveform segments A and D, the input waveform segments are outputted with no deformation; however, the waveform segments B and C becomes the waveform segments E and J which have amplitudes being substantially different from that of the waveform segments B and C as shown in FIG. 8(*b*).

SUMMARY OF THE INVENTION

Therefore, a principal object of the present invention is to provide a novel method for compressing/expanding a time-scale of a sound signal.

Another object of the present invention is to provide a method for a compressing/expanding a time-scale of a sound signal, in which no distortion occurs in a sound waveform.

A compression/expansion method of a time-scale of a sound signal according to the present invention comprises: a compression process (A) including steps of (a-1) cutting-out two sound waveform segments each having a length of single pitch period from an input sound signal at a first time point represented by a current pointer and at a second time point advanced from the first time point by the single pitch period, respectively, (a-2) producing a single sound waveform segment that is obtained through compression of the two sound waveform segments by adding the two sound waveform Segments to each other with suitable weights, (a-3) moving the pointer to a fifth time point according to a compression rate, and outputting an input sound waveform segment from a time point advanced from the second time point by the single pitch period to the fifth time point as it is, the sound waveform segment produced in the step (a-2) being followed by the input sound waveform segment, or (a-4) moving the pointer to the fifth time point according to the compression rate, and outputting a portion of the waveform segment produced in the step (a-2) as it is, and (a-5) repeating the steps (a-1)–(a-3) or the steps (a-1), (a-2) and (a-4) as necessary; and an expansion process (B) including steps of (b-1) receiving the sound waveform being compressed by the compression process (A) as an input sound signal, (b-2) cutting-out two sound waveform segments each having a length of N times (N is an integer more than 2) the single pitch period from the input sound signal at a third time point represented by the current pointer and at a fourth time point delayed from the third time point by the single pitch period, respectively, (b-3) producing a single synthesized sound waveform segment that is obtained through synthesization of the two sound waveform segments by adding the two sound waveform segments to each other with suitable weights, (b-4) moving the pointer to a sixth time point according to an expansion rate, and outputting an input sound waveform segment from a time point advanced from the third time point by (N−1) pitch period to the sixth time point as it is, the sound waveform segment produced in the step (b-3) being followed by the input sound waveform segment, or (b-5) moving the pointer to a sixth time point according to the expansion rate, and outputting a portion of the waveform segment produced in the step (b-3) as it is, and (b-6) repeating the steps (b-2)–(b-4) or the steps (b-2), (b-3) and (b-5) as necessary.

A compression/expansion method of a time-scale of a sound signal according to the present invention comprises: a compression process (A) including steps of (a-1) cutting-out two sound waveform segments each having a length of N times (N is an integer more than 2) a single pitch period from an input sound signal at a first time point represented by a current pointer and at a second time point advanced from the first time point by the single pitch period, respectively, (a-2) producing a single sound waveform segment that is obtained through compression of the two sound waveform segments by adding the two sound waveform segments to each other with suitable weights, (a-3) moving the pointer to a fifth time point according to a compression rate, and outputting an input sound waveform segment from a time point advanced from the second time point by N pitch period to the fifth time point as it is, the sound waveform segment produced in the step (a-2) being followed by the input sound waveform segment, or (a-4) moving the pointer to the fifth time point according to the compression rate, and outputting a portion of the waveform segment produced in the step (a-2) as it is, and (a-5) repeating the steps (a-1)–(a-3) or the steps (a-1), (a-2) and (a-4) as necessary; and an expansion process (B) including steps of (b-1) receiving the sound waveform being compressed by the compression process (A) as an input sound signal, (b-2) cutting-out two sound waveform segments each having a length of M times (M is an integer more than 2) the single pitch period from the input sound signal at a third time point represented by the current pointer and at a fourth time point delayed from the third time point by the single pitch period, respectively, (b-3) producing a single synthesized sound waveform segment that is obtained through synthesization of the two sound waveform segments by adding the two sound waveform segments to each other with suitable weights, (b-4) moving the pointer from a sixth time point according to an expansion rate, and outputting an input sound waveform segment from a time point advanced from the third time point by (M-1) pitch period to the sixth time point as it is, the sound waveform segment produced in the step (b-3) being followed by the input sound waveform segment, or (b-5) moving the pointer to a sixth time point according to the expansion rate, and outputting a portion of the waveform segment produced in the step (b-3) as it is, and (b-6) repeating the steps (b-2)–(b-4) or the steps (b-2), (b-3) and (b-5) as necessary.

Now, N may be equal to M or N may be different from M. Preferably, N is selected to be smaller than K.

A compression method of a time-scale of a sound signal according to the present invention comprises steps of: (a-1) cutting-out two sound waveform segments each having a length of N times (N is an integer more than 2) a single pitch period from an input sound signal at a first time point represented by a current pointer and at a second time point advanced from the first time point by the single pitch period, respectively; (a-2) producing a single sound waveform segment that is obtained through compression of the two sound waveform segments by adding the two sound waveform segments to each other with suitable weights; (a-3) moving the pointer to a fifth time point according to a compression rate, and outputting an input sound waveform segment from a time point advanced from the second time point by N pitch period to the fifth time point as it is, the sound waveform segment produced in the step (a-2) being followed by the input sound waveform segment, or (a-4) moving the pointer to the fifth time point according to the compression rate, and outputting a portion of the waveform segment produced in the step (a-2) as it is, and (a-5) repeating the steps (a-1)–(a-3) or the steps (a-1), (a-2) and (a-4) as necessary.

An expansion method of a time-scale of a sound signal according to the present invention comprises steps of: (b-1) cutting-out two sound waveform segments each having a length of N times (K is an integer more than 2) a single pitch period from the input sound signal at a third time point represented by the current pointer and at a fourth time point delayed from the third time point by the single pitch period, respectively, (b-2) producing a single synthesized sound waveform segment that is obtained through synthesization of the two sound waveform segments by adding the two sound waveform segments to each other with suitable weights, (b-3) moving the pointer to a sixth time point according to an expansion rate, and outputting an input sound waveform segment from a time point advanced from the third time point by (N−1) pitch period to the sixth time point as it is, the sound waveform segment produced in the step (b-2) being followed by the input sound waveform segment, or (b-4) moving the pointer to a sixth time point according to the expansion rate, and outputting a portion of the waveform segment produced in the step (b-2) as it is, and (b-5) repeating the-steps (b-1)–(b-3) or the steps (b-1), (b-2) and (b-4) as necessary.

In accordance with the present invention, the length of sound waveform segments to be added to each other in the compression and/or the expansion process are constant irrespective of the compression/expansion rate, and the compression/expansion rate is determined by a moving amount of the pointer, and therefore, the deviation of the sound waveform due to the fluctuation of the pitch period with respect to the input sound waveform is suppressed, and accordingly, a waveform distortion becomes small.

The above described objects and other objects, features, aspects and advantages of the present invention will become more apparent from the following detailed description of the present invention when taken in conjunction with the accompanying drawings.

DETAILED DESCRIPTION OF THE PREFERRED EMBODIMENTS

Figure 10:
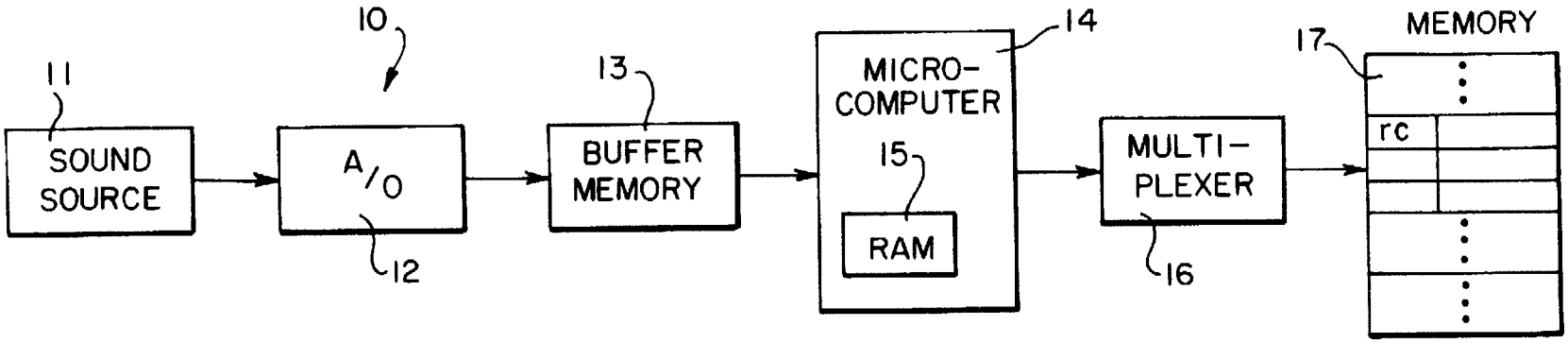
FIG. 10 is a block diagram showing a time-scale compression apparatus according to one embodiment of the present invention.

A time-scale compression apparatus 10 of this embodiment shown in FIG. 10 includes a sound source 11 such as a microphone, sound output circuit and etc., and an analog sound signal from the sound source 11 is sampled and converted into a digital sound signal by an AID converter 12. In this embodiment shown, a sampling frequency of the AID converter 12 is set as 8 kHz, for example.

The digital sound signal from the A/D converter 12 is temporarily stored in a buffer memory 13. A microcomputer 14 reads the digital sound signal stored in the buffer memory 13 for each block, and performs a time-scale compression of the sound signal. More specifically, the microcomputer 14 evaluates a pitch period T of the sound signal read from the buffer memory 13 in accordance with the aforementioned method. Furthermore, the microcomputer 14 compresses the digital sound signal from the buffer memory 13 with a compression rate rc that is set in advance or inputted. At this time, the microcomputer 14 processes the data with utilizing a RAM 15 incorporated therein. That is, the RAM 15 is used as a pointer memory, and as a working memory. Therefore, the pitch period T, the compression rate rc and a compressed digital sound signal are outputted from the microcomputer 14. The pitch period T, the compression rate rc and the digital sound signal are written in a memory 17 via a multiplexer 16.

Figure 11:
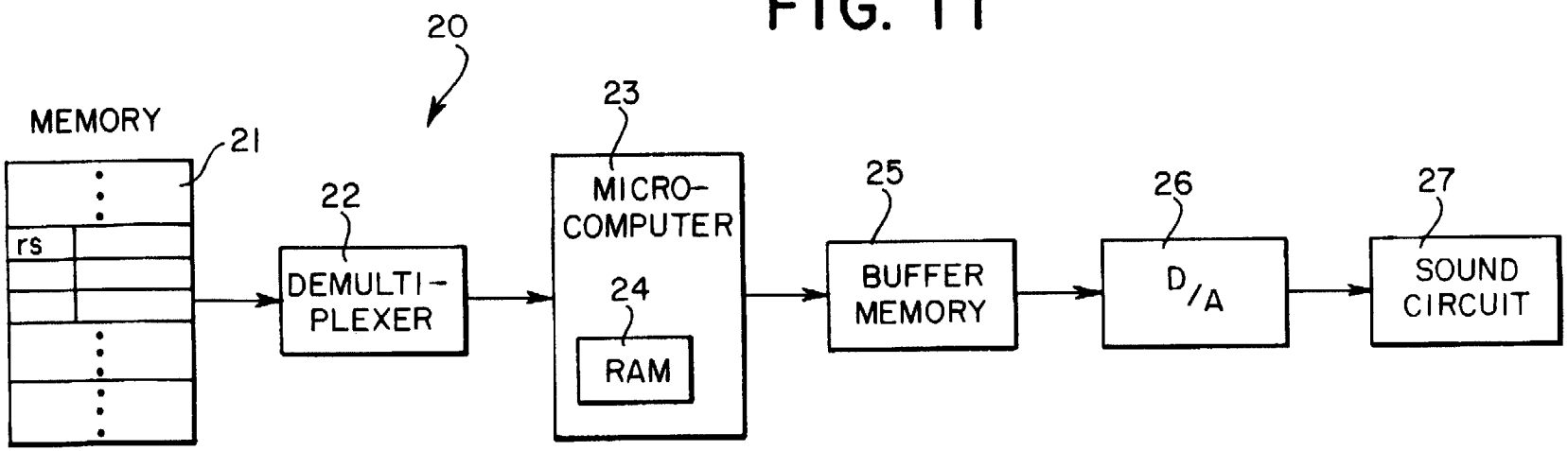
FIG. 11 is a block diagram showing a time-scale expansion apparatus according to one embodiment of the present invention.

A time-scale expansion apparatus 20 of this embodiment shown in FIG. 11 includes a memory 21 which is the same or similar of the above described memory 17, and the pitch period T, the compression rate rc and the digital sound signal are outputted to a microcomputer 23 from the memory 21 via a demultiplexer 23. The microcomputer 23 reads the data for each block, and performs a time-scale expansion of the sound signal. More specifically, the microcomputer 23 expands the digital sound signal read from the memory 21 with an expansion rate rs that is set in advance or inputted, by utilizing RAM 24. Therefore, the digital sound signal having a time-scale expanded is outputted from the microcomputer 23, and the data is temporarily stored in a buffer memory 25. The digital sound signal stored in the buffer memory 25 is converted into an analog sound signal by a D/A converter 26, and then, outputted. The analog sound signal is applied to a sound output circuit 27, and therefore, a sound is outputted from a speaker (not shown), for example.

In addition, the compression apparatus 10 and the expansion apparatus 20 respectively shown in FIG. 10 and FIG. 11 are incorporated in a telephone answering machine, for example. In such a case, a single microcomputer is utilized as the microcomputer 14 (FIG. 10) or the microcomputer 23 (FIG. 11), and a single memory is utilized as the memory 17 (FIG. 10) or the memory 21 (FIG. 11).

Figures 1A, 1B:
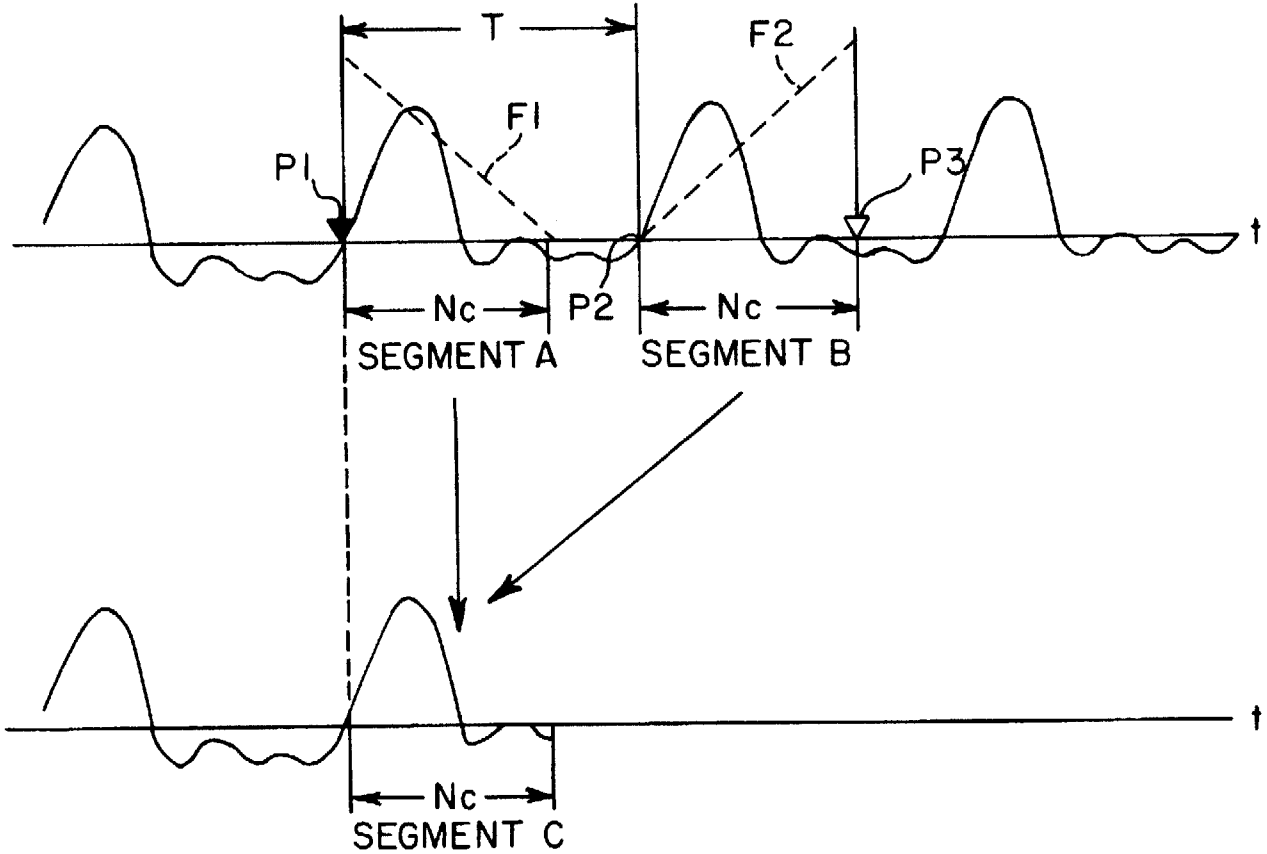
FIG. 1a PRIOR ART
FIG. 1b PRIOR ART
FIGS. 1A and 1B are a waveform chart showing a time-scale compression of a sound signal according to a prior art TDHS system.
Figures 2A, 2B:
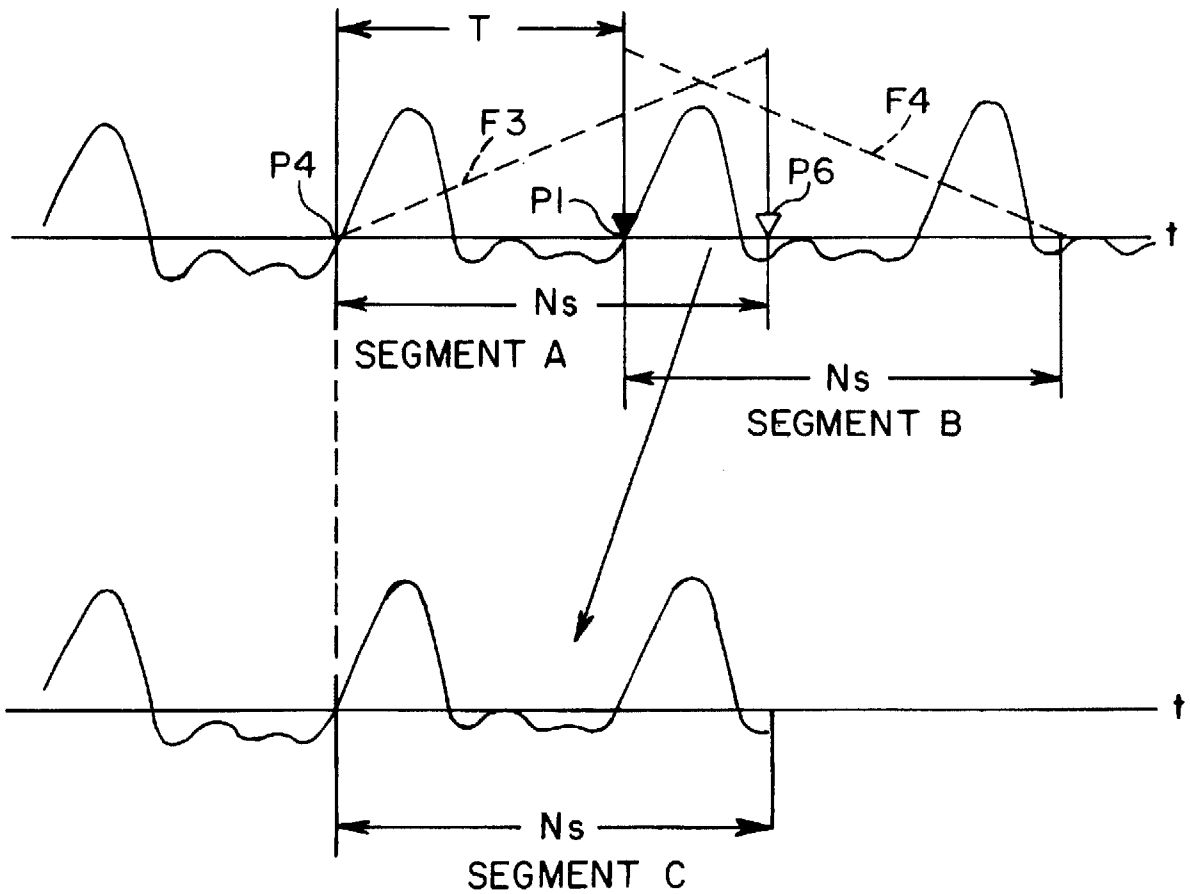
FIG. 2a PRIOR ART
FIG. 2b PRIOR ART
FIG. 2 is a waveform chart showing a time-scale expansion of a sound signal according to the prior art TDHS system.
Figure 3:
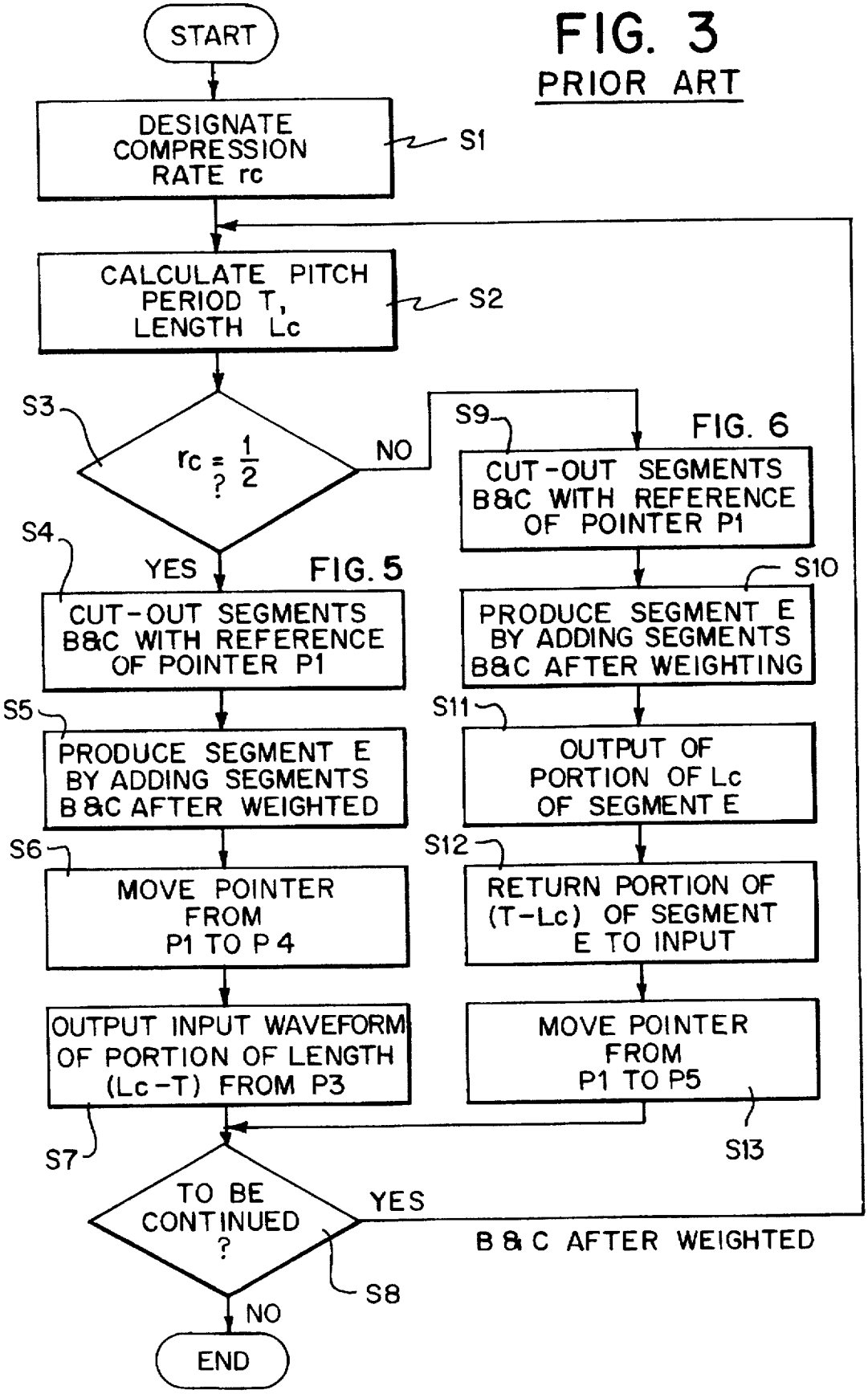
FIG. 3 PRIOR ART
FIG. 3 is a flowchart showing a time-scale compression of a sound signal according to a prior art PICOLA system.
Figure 4:
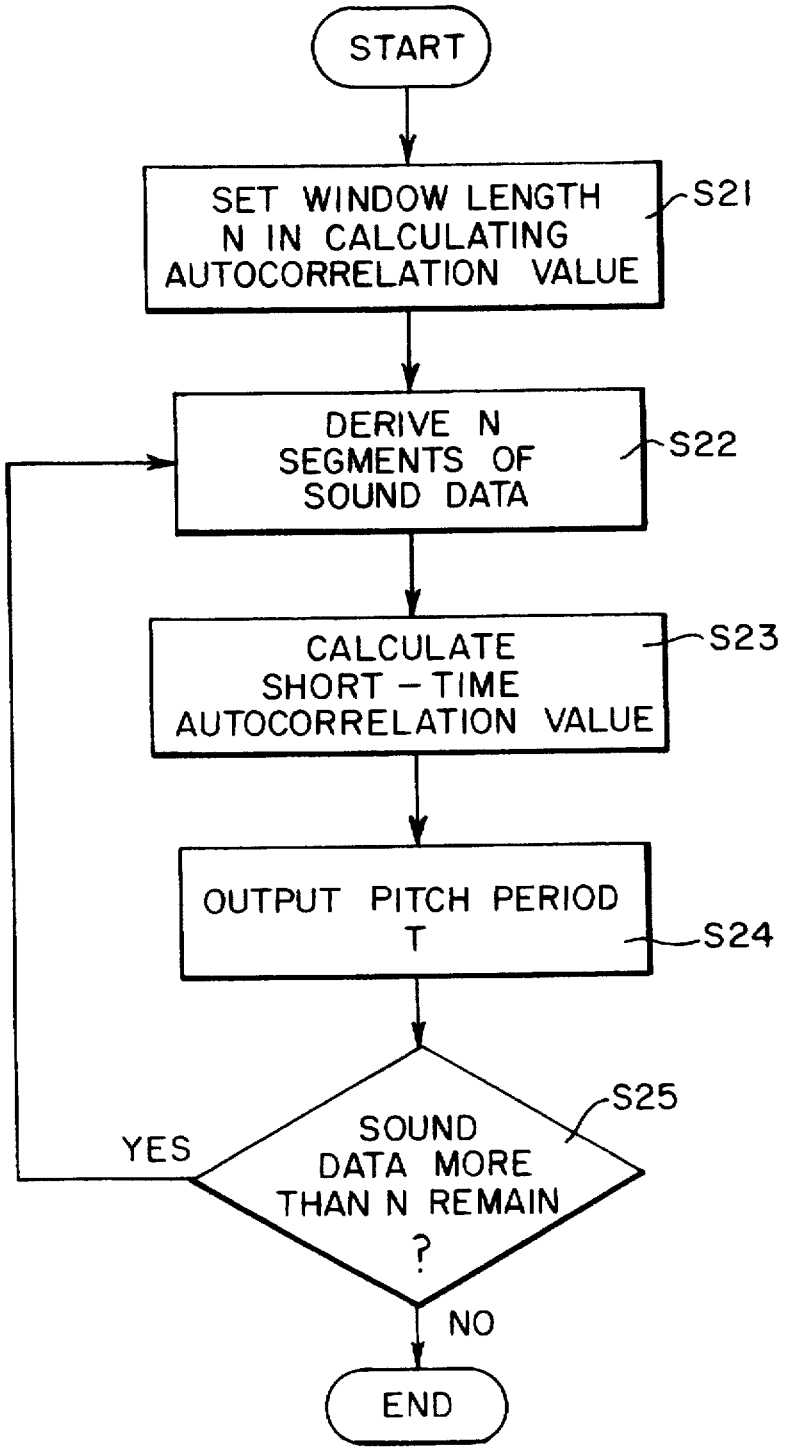
FIG. 4 PRIOR ART
FIG. 4 is a flowchart showing one example of a method for evaluating a pitch period.
Figure 5A:
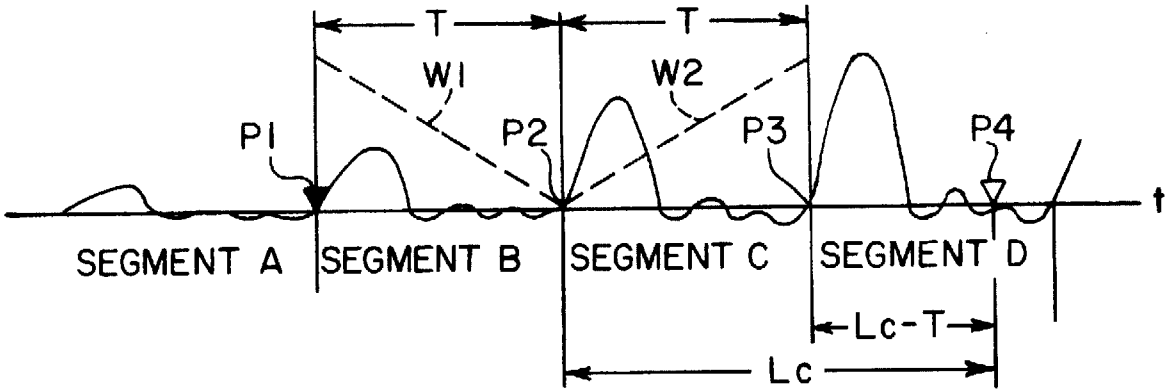
FIG. 5a PRIOR ART
FIG. 5 is a waveform chart showing a time-scale compression of a sound signal according to the prior art PICOLA system.
Figure 5B:
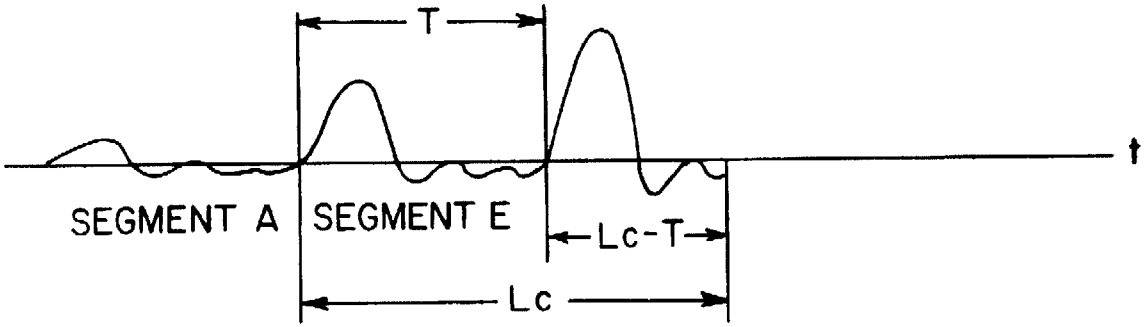
FIG. 5b PRIOR ART
Figure 6A:
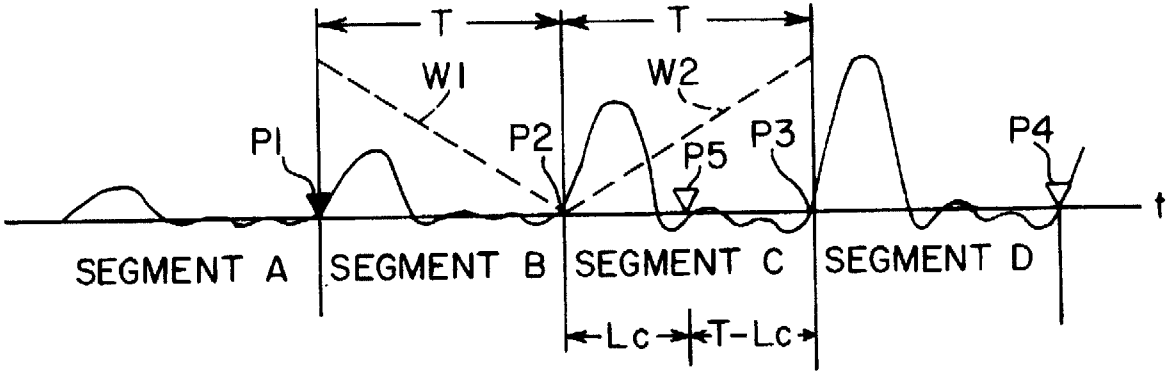
FIG. 6a PRIOR ART
FIG. 6 is a waveform chart showing a time-scale compression of a sound signal according to the prior art PICOLA system.
Figure 6B:
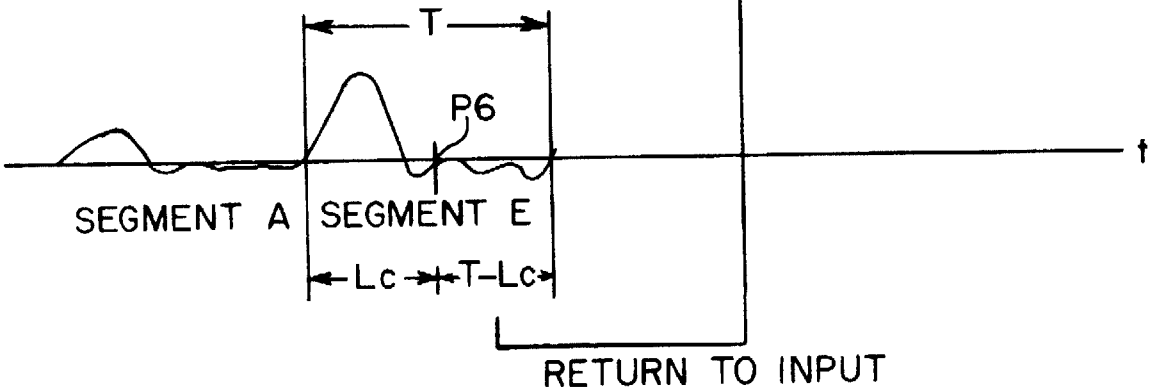
FIG. 6b PRIOR ART

In a first embodiment, a sound waveform processing shown in FIG. 5 or FIG. 6 is performed in accordance with the PICOLA system shown by the flowchart in FIG. 3, and therefore, the input sound signal Is compressed with the compression rate rc, and the same is stored in the memory 17 (FIG. 10). In expanding the time-scale of the sound waveform, the sound signal data thus stored in the memory 17 is processed.

Figure 12:
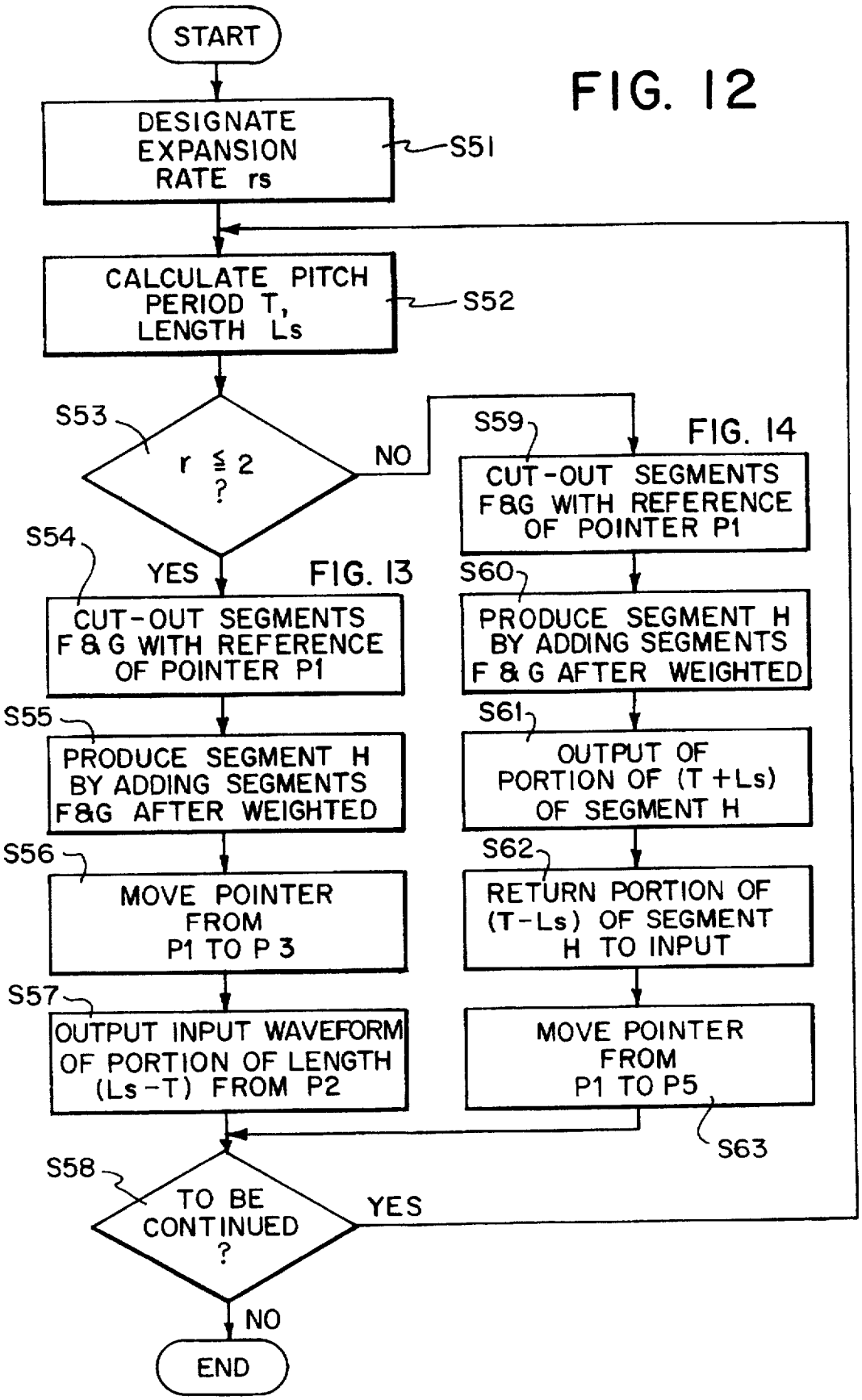
FIG. 12 is a flowchart showing one example of an operation of a time-scale expansion of a sound signal in FIG. 11 embodiment.

More specifically, in a step S51 of FIG. 12, an expansion rate rs is designated or set. Specifically, the expansion rate rs may be set as a reciprocal of the compression rate rc. In a next step S52, a pitch period T of an input sound waveform is calculated, and a length Ls of a waveform segment is calculated on the basis of the above described equation (7) by utilizing the pitch period T. In addition, in a case where the pitch period is independently calculated in the expansion apparatus, it is unnecessary to store the data of the pitch period in the memory 17 (FIG. 10) of the memory 21 (FIG. 11). Accordingly, in such a case, the multiplexer 16 and the demultiplexer 22 become unnecessary.

In a step S53, it is determined whether or not the expansion rate rs designated in the step S51 is equal to or smaller than 2 (200%). If "YES" is determined, that is, $rs \leqq 2$ is determined in the step S53, in order to process the sound waveform according to FIG. 13, the process proceeds to a step S54, and if "NO" is determined, that is, $rs > 2$ is determined in the step S53, the process proceeds to a step S59 such that the sound waveform is processed according to FIG. 14.

Figures 13A, 13B:
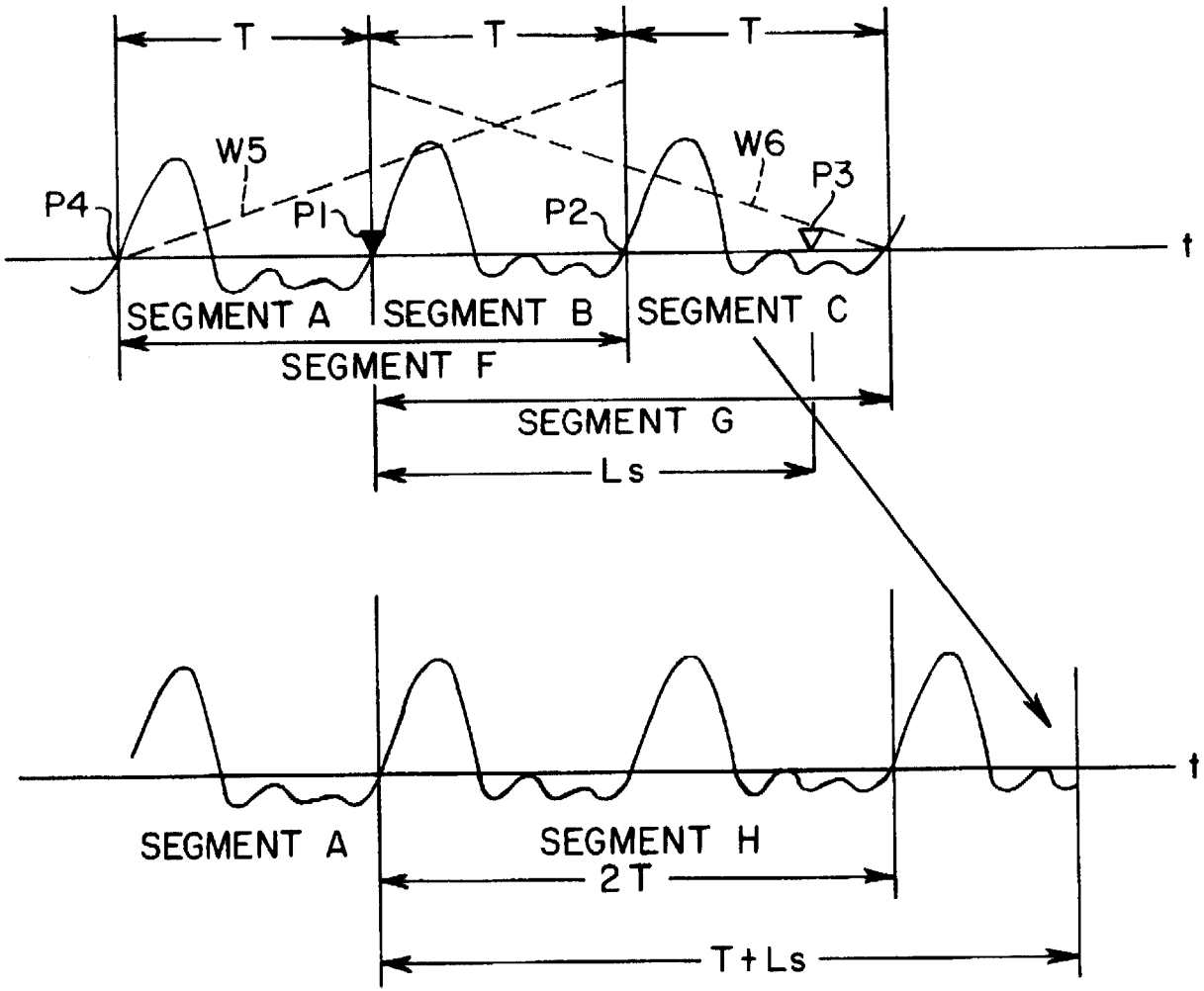
FIG. 13 is a waveform chart showing a time-scale expansion of a sound signal in FIG. 12 embodiment.

In a step S54, as shown in FIG. 13(*a*), a sound waveform segment F (sound waveform segments A+B) and a sound waveform segment G(sound waveform segments B+C) each having a length of 2T are cut-out at a time point P1 represented by the current pointer and a time point P4 delayed from the time point P1 by the single pitch period T, respectively. In a next step S55, a weight that is linearly changed from 0 to 1, i.e., a window function $W5=i/(2T-1)$ ($i=0, 1, \ldots, 2T-1$) is multiplied by the sound waveform segment F, and a weight that is linearly changed from 1 to 0, i.e., a window function $W6=1-i/(2T-1)$ is multiplied by the sound waveform segment G, and then, by adding the two sound waveform segments to each other, a sound waveform segment H having a length of 2T is produced. In a step S56, the pointer is moved to a time point P3 advanced from the time point P1 by "Ls+T" on an input sound waveform. In a step S57, the input waveform segment of a length of "Ls−T" from a time point P2 to the time point P3 is outputted as a sound waveform segment by which the sound waveform segment H is followed. In a step S58, it is determined whether or not the expansion process is to be continued, and if "YES" is determined, the process returns to the step S52, and if "NO" is determined, the process is terminated.

When "NO" is determined in the step S53, the process proceeds to the step S59; however, since the steps S59 and S60 are basically the same as the steps S54 and 655, respectively, a duplicate description will be omitted here.

Figure 14A:
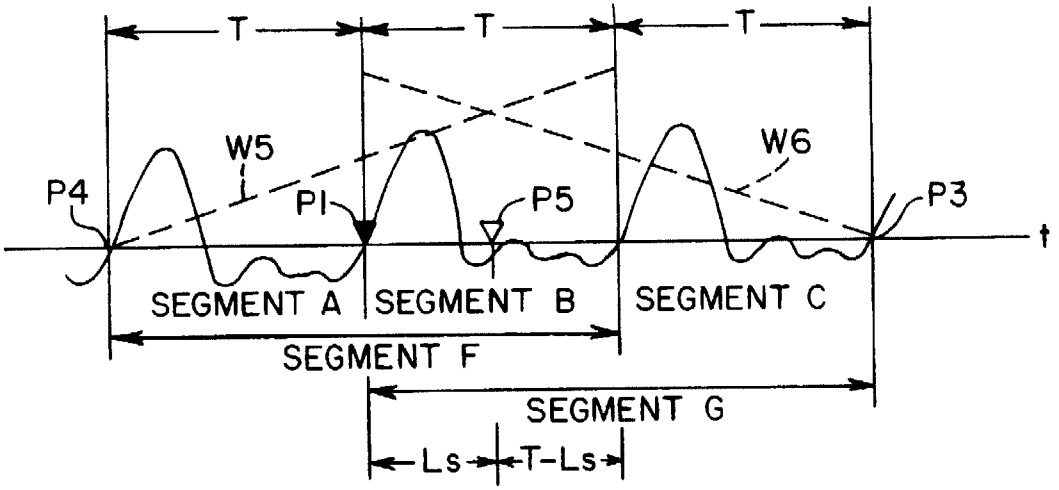
FIG. 14 is a waveform chart showing a time-scale expansion of a sound signal in FIG. 12 embodiment.
Figure 14B:
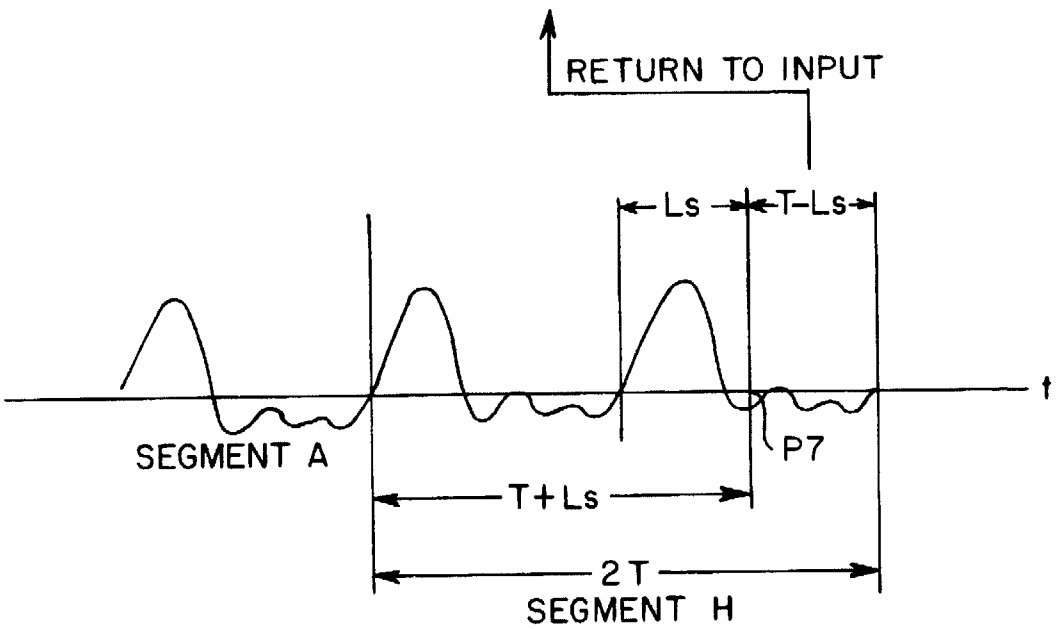

Then, in a step S61, as shown in FIG. 14(*a*) and FIG. 14(*b*), a sound waveform segment of a portion having a length of "T+Ls" from a head of the sound waveform segment H produced in the step S60 is outputted. In a step S62, a waveform segment of a portion of "T−Ls" after a time point P7 of the sound waveform segment H is returned to the input. The pointer is moved from the time point P1 to a time point P5 in a step S63, and thereafter, the process proceeds to the step S58.

Thus, at a time of $rs \geqq 2$, the pointer is moved to the time point P5 advanced from the time point P1 by "Ls" on the input sound waveform shown in FIG. 14(*a*), and then, only the sound waveform segment of the portion with the length "T−Ls" from the head of the sound waveform segment H is outputted, and the sound waveform segment of the portion of "T−Ls" is returned to the input so as to be utilized again for a succeeding process. A reason why the sound waveform segment of the portion of "T−Ls" is returned to the input is to keep a continuity at the time point P7 of the output waveform segment H because the expansion performed in FIG. 14(*a*) is aimed at the input sound waveform after the time point P5.

Thus, according to the flowchart shown in FIG. 12, the sound waveform processing shown in FIG. 13 or FIG. 14 is performed, and therefore, the input sound signal is expanded with the expansion rate rs, and the same is stored in the buffer memory 25, and then, outputted from the D/A converter 26 to the sound output circuit 27 (FIG. 11).

Figure 8A:
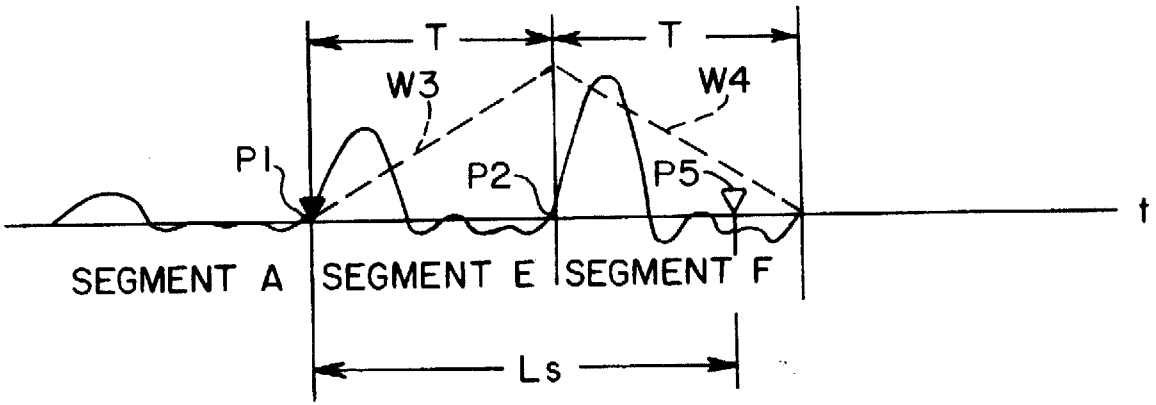
FIG. 8a PRIOR ART
FIG. 8 is a waveform chart showing a time-scale expansion of a sound signal according to the prior art PICOLA system.
Figure 8B:
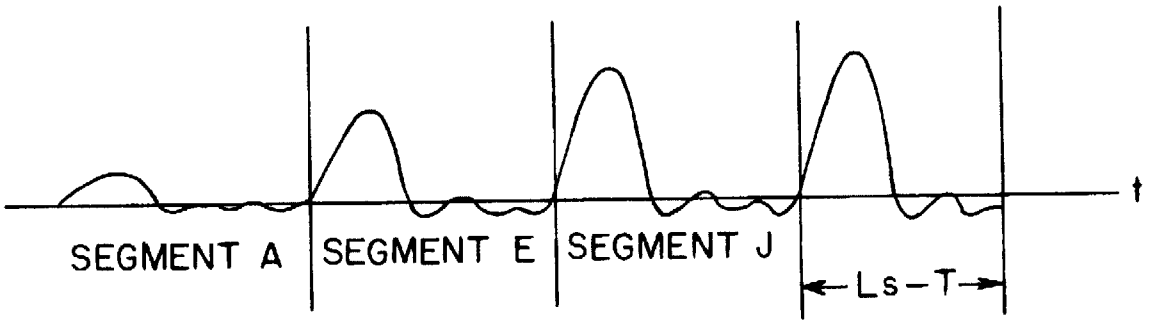
FIG. 8b PRIOR ART
Figure 9A:
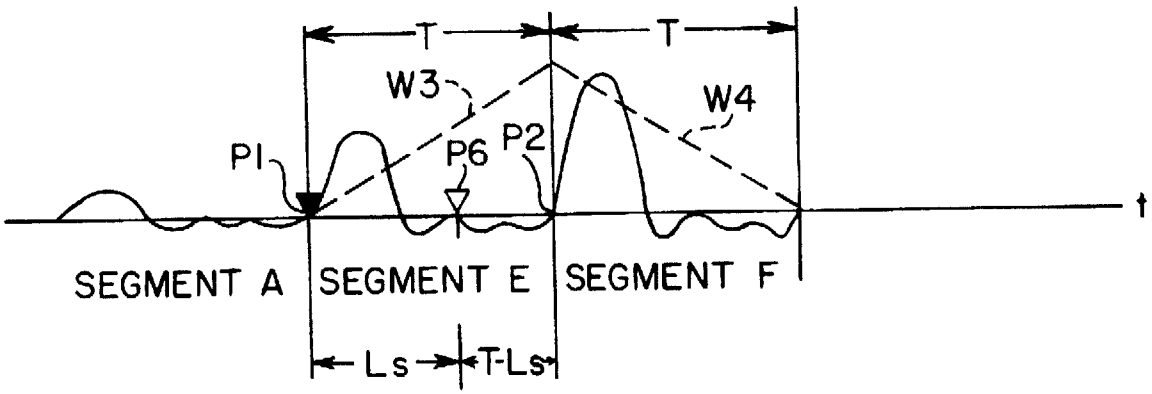
FIG. 9a PRIOR ART
FIG. 9 is a waveform chart showing a time-scale expansion of a sound signal according to the prior art PICOLA system.
Figure 9B:
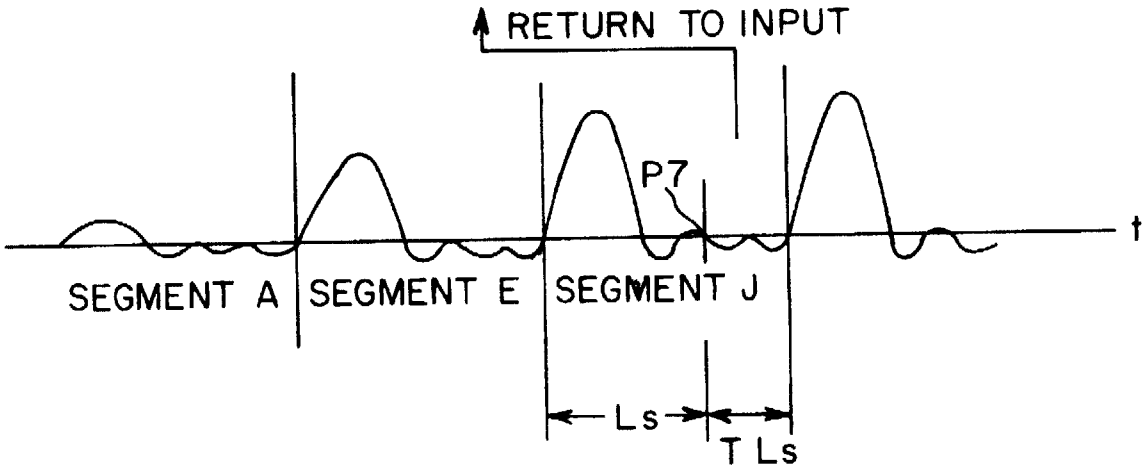
FIG. 9b PRIOR ART

If the sound waveform segment having a length of 2T is cut-out as done in the above described embodiment, a level variation of the input sound signal is relatively surely reflected, and therefore, a wave form distortion is small. More specifically, in the PICOLA system shown in FIG. 5 and FIG. 8, the input sound signal shown in FIG. 5(*a*) is compressed and the sound waveform shown in FIG. 5(*b*) is obtained, and the sound waveform of FIG. 5(*b*) is expanded, and therefore, the sound waveform shown in FIG. 8(*b*) is obtained. As each of the sound waveform segment A and D, the input sound waveform is outputted as it is; however, the input sound waveform segments B and C becomes sound waveform segments E and J in FIG. 8(*b*), in which amplitude values are substantially distorted.

Figure 15A:
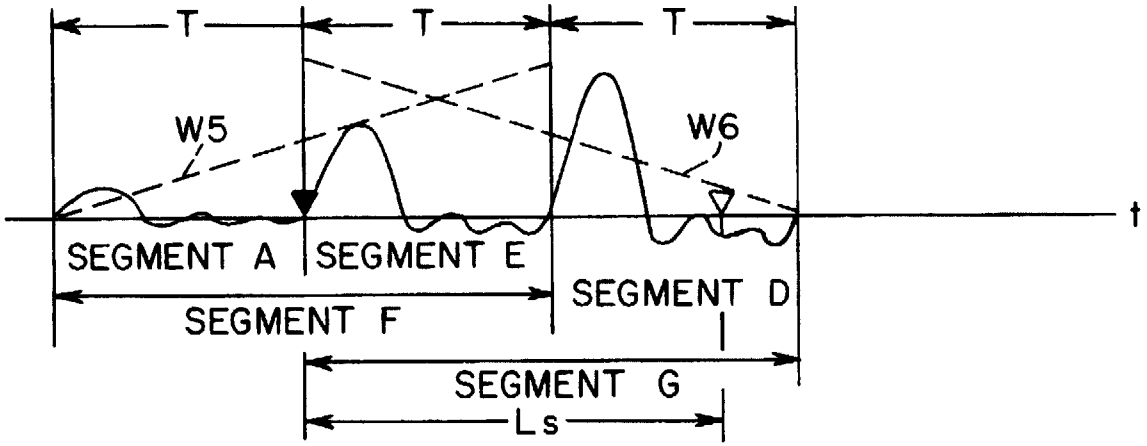
FIG. 15 is a waveform chart showing another example of a time-scale expansion of a sound signal in FIG. 11.
Figure 15B:
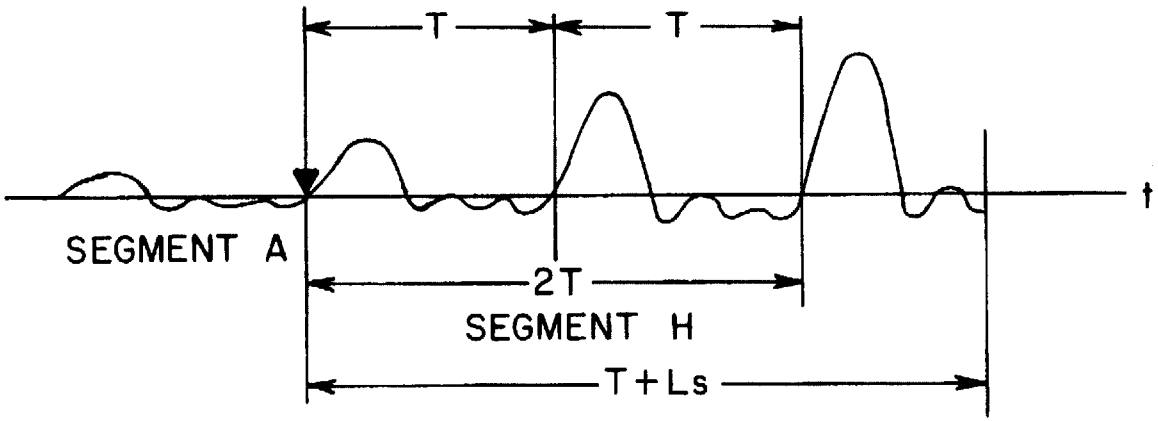

In contrast, a result that is obtained by compressing the input sound signal of FIG. 5(*a*) and expanding according to the above described embodiment is shown in FIG. 15. In comparing FIG. 5(*a*) and FIG. 15(*b*) with each other, the input sound waveform segments A and D are outputted with no deformation, and the input sound waveform segments B and C becomes the sound waveform segment H which is very similar to the segments B and C. Therefore, according to the above described embodiment, the waveform distortion becomes very small.

Figure 16:
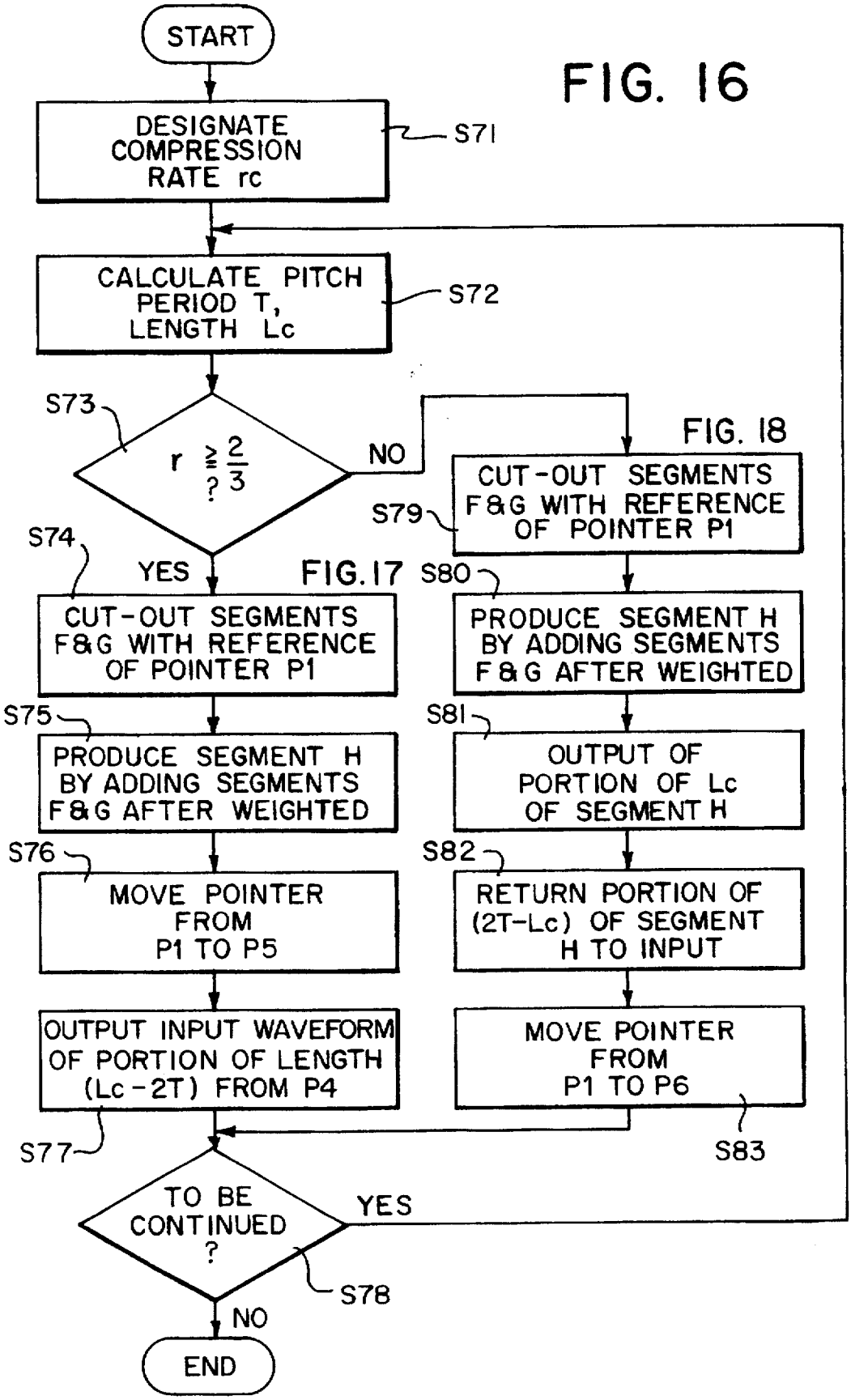
FIG. 16 is a flowchart showing another example of an operation of a time-scale compression of a sound signal in FIG. 10 embodiment.

Another embodiment of a time-scale compression is shown by a flowchart in FIG. 16. In the previous embodiment, the sound waveform segment having the length T equal to the pitch period T is cut-out. In contrast, in this embodiment shown, a sound waveform segment having a length of 2T that is equal to double the single pitch period T.

Steps S71 and S72 of FIG. 16 are the same as the steps S1 and S22 shown in FIG. 3, and therefore, a duplicate description will be omitted here.

Then, in a step S73, it is determined whether or not the compression rate rc is equal to or larger than ⅔ (approximately 67%). If "YES" is determined in the step S73, in order to perform the sound waveform processing according to FIG. 17, the process proceeds to a step S74. If "NO" is determined in a step S73, in order to perform the sound waveform processing according to FIG. 18, the process proceeds to a step S79.

In a step S74, waveform segments F (waveform segment A+waveform segment B) and a (waveform segment B+waveform segment C) each having a length of 2T are cut-out at a time point P1 represented by a current pointer and a time point P2 advanced from the time point P1 by the single pitch period T, respectively. In a next step S75, a weight that is linearly changed from 1 to 0, i.e., a window function $W7=1-i/(2T-1)$ ($i=0, 1, \ldots, 2T-1$) is multiplied by the sound waveform segment F, and a weight that is linearly changed from 0 to 1, i.e., a window function $W8=i/(2T-1)$ is multiplied by the sound waveform segment G, and then, by adding the two sound waveform segments to each other, a sound waveform segment H having a length of 2T is produced.

Figures 17A, 17B:
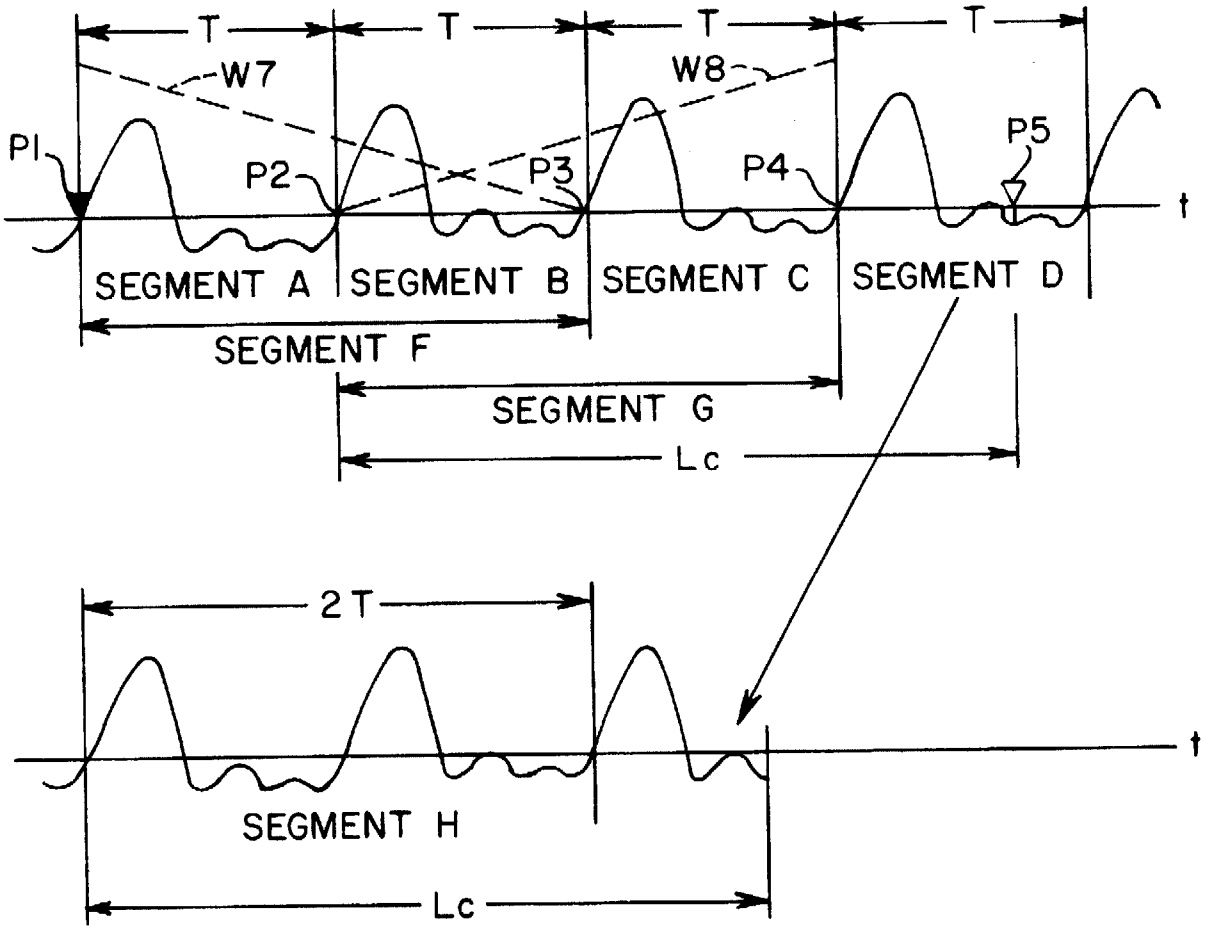
FIG. 17 is a waveform chart showing a time-scale compression of a sound signal in FIG. 16 embodiment.

In a step S78, the pointer is moved on the input sound waveform shown in FIG. 17(*a*) from the time point P1 to the time point P5 advanced from the time point P1 by "T+Lc". In a step S77, the input sound waveform segment of the length of "Lc−2T" from the time point P4 to the time point P5 is outputted as a sound waveform segment by which the sound waveform segment H is followed. Furthermore, in a step S78, it is determined whether or not the compression process is to be continued, and in a case of "YES", the process returns to the step S72, and in a case of "NO", the process is terminated.

When "NO" is determined in the step S73, the process proceeds to the step S79; however, since the steps S79 and S80 are basically the same as the steps S74 and S75, respectively, a duplicate description will be omitted here.

Figure 18A:
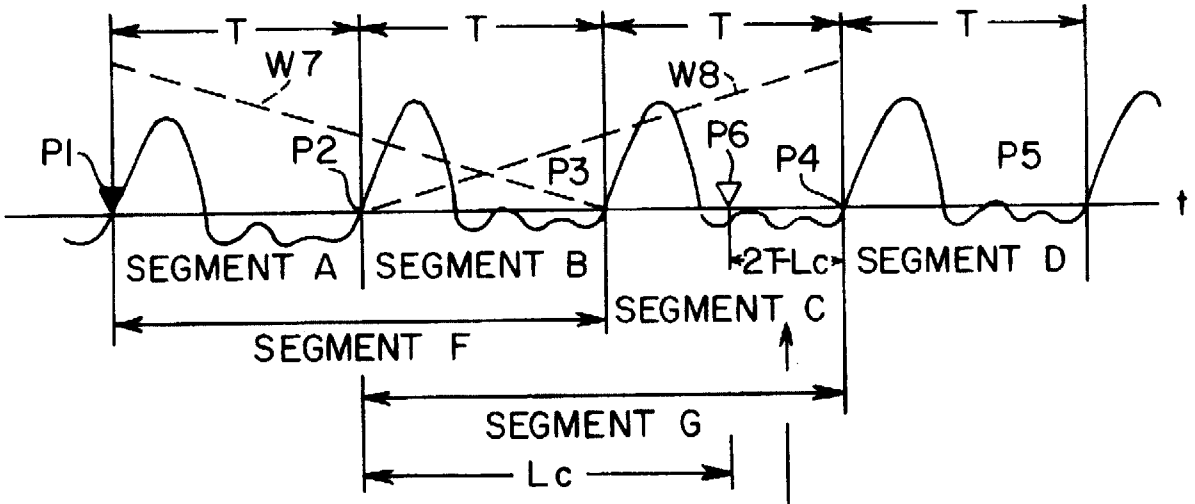
FIG. 18 is a waveform chart showing a time-scale compression of a sound signal in FIG. 16.
Figure 18B:
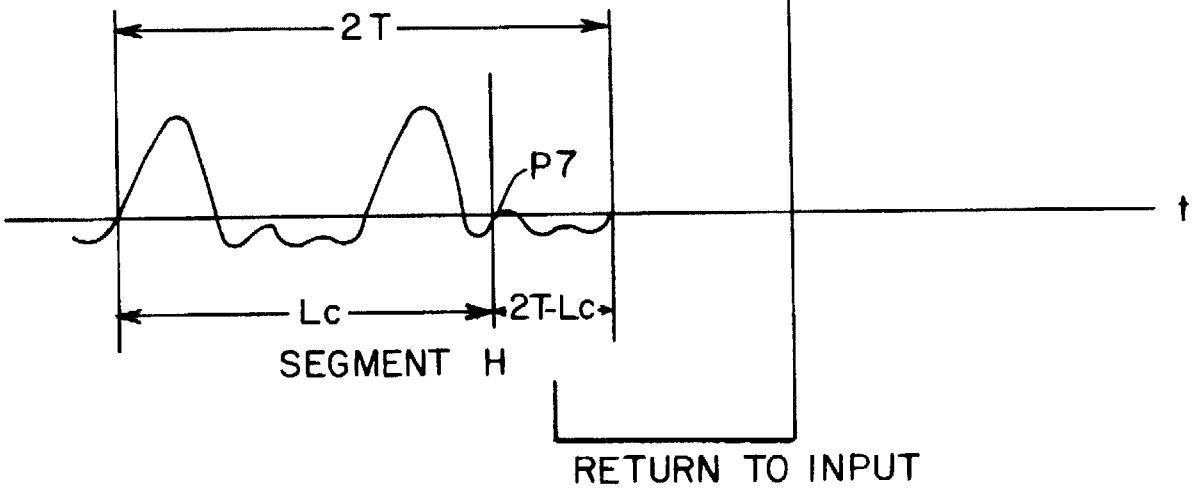

Then, in a step S81, as shown in FIG. 18(*a*) and FIG. 18(*b*), a sound waveform segment of a portion having a length of Lc from a head of the sound waveform segment H produced in the step S80 is outputted. In a step S82, a waveform segment of a portion of "2T−Lc" after a time point P7 of the sound waveform segment H is returned to the input. The pointer is moved from the time point P1 to a time point P6 in a step S83, and thereafter, the process proceeds to the step S78.

Thus, at a time of $rc \geqq ⅔$, the pointer is moved to the time point P6 advanced from the time point P1 by "T+Lc" on the input sound waveform shown in FIG. 18(*a*), and then, only the sound waveform segment of the portion with the length Lc from the head of the sound waveform segment H is outputted, and the sound waveform segment of the portion of "2T−Lc" is returned to the input so as to be utilized again for a succeeding process. A reason why the sound waveform segment of the portion of "2T−Lc" is returned to the input is to keep a continuity at the time point P7 of the output waveform segment H because the compression process performed in FIG. 18(*a*) is aimed at the input sound waveform after the time point P6.

Figure 7A:
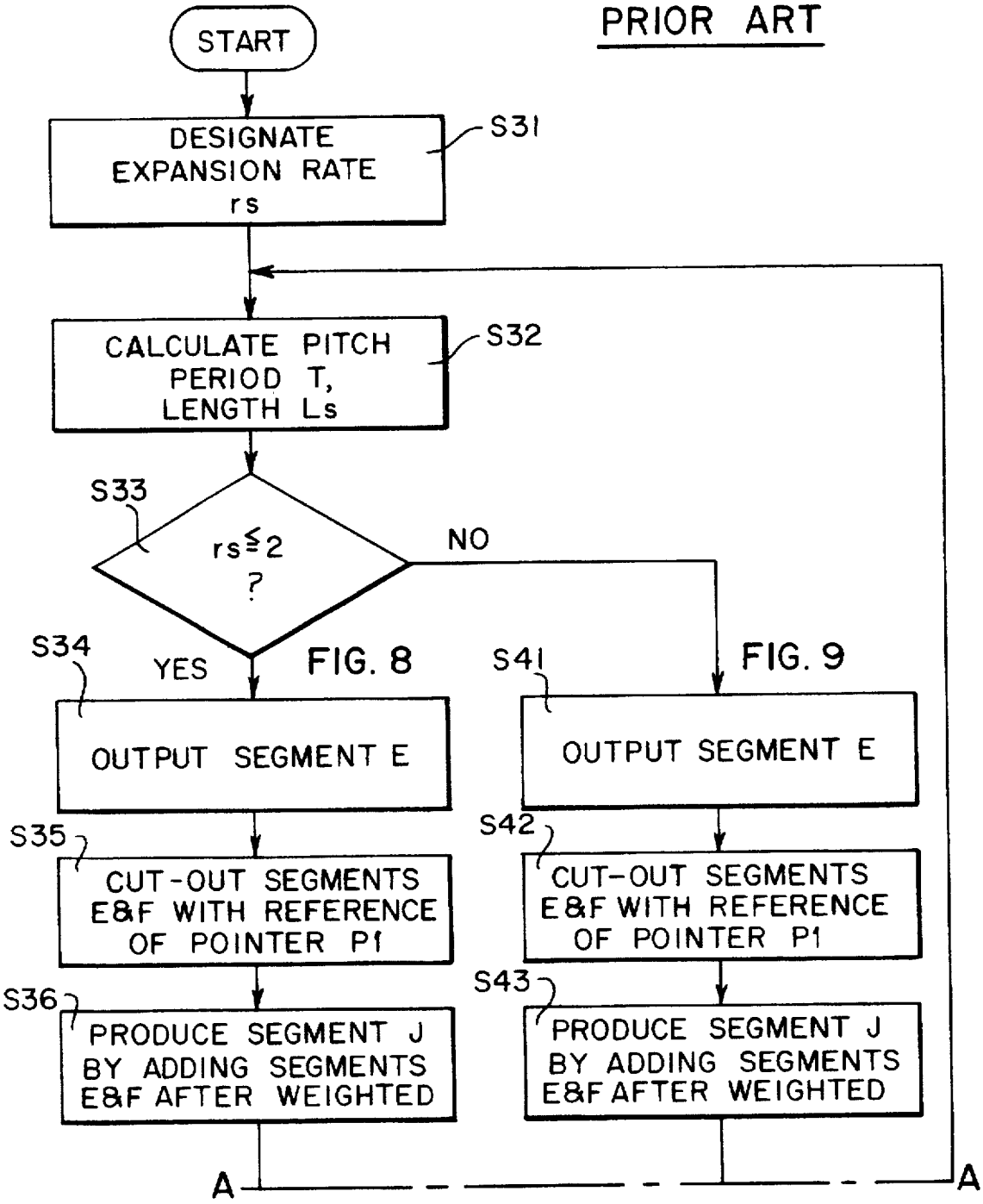
FIG. 7a PRIOR ART
FIG. 7 is a flowchart showing a time-scale expansion of a sound signal according to the prior art PICOLA system.
Figure 7B:
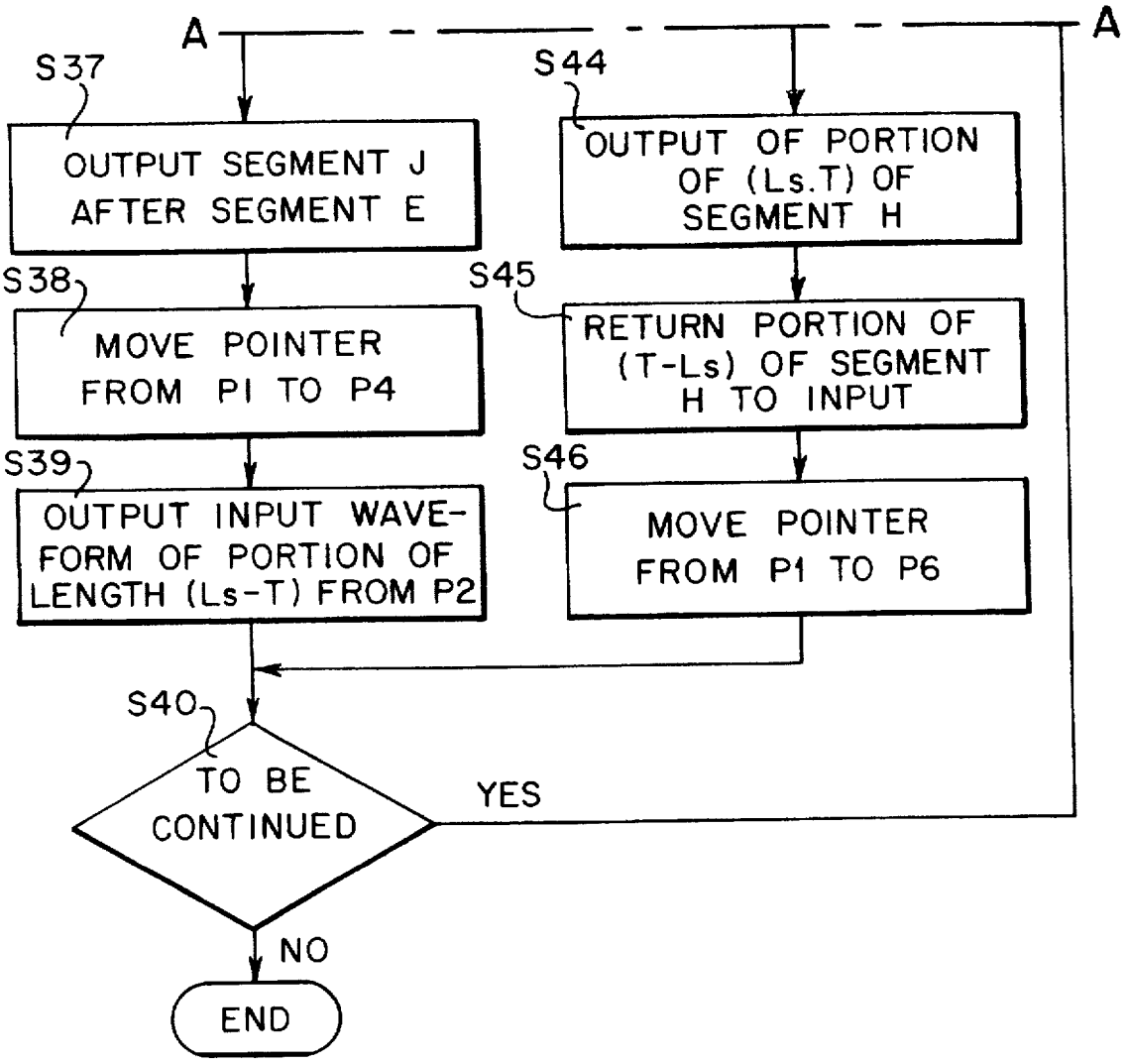
FIG. 7b PRIOR ART
Figure 19:
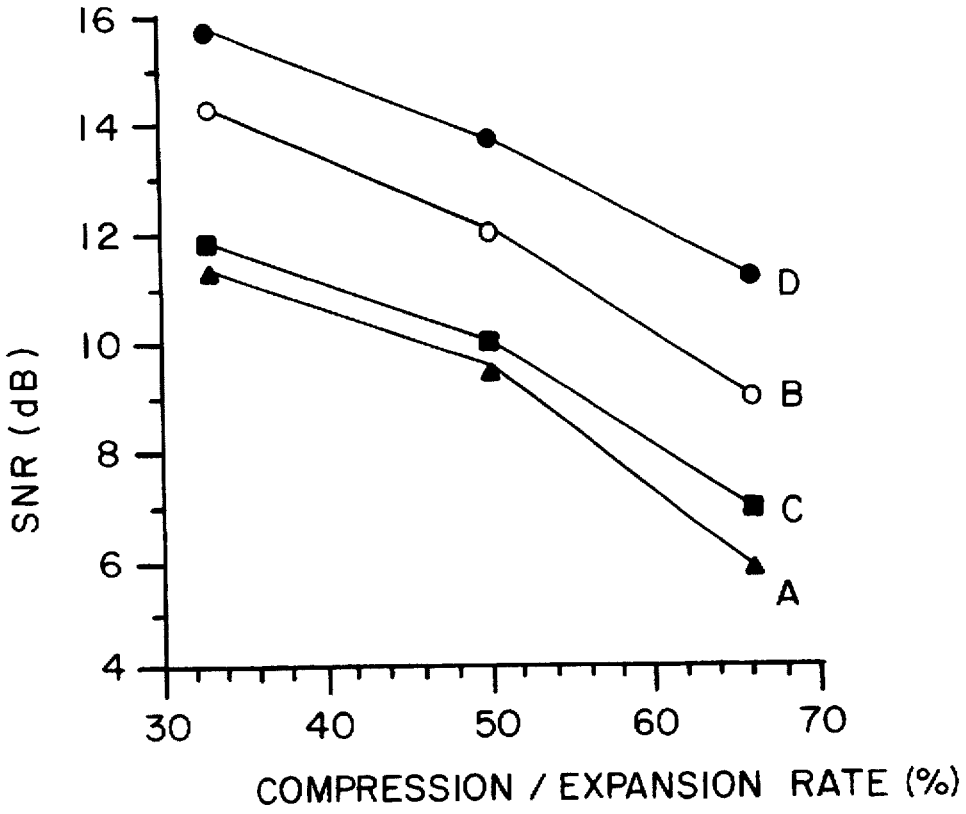
FIG. 19 is a graph showing a relationship between an SIN ratio and a compression/expansion rate according to the embodiment of the present invention in comparing that of the prior art PICOLA system.
Figure 20:
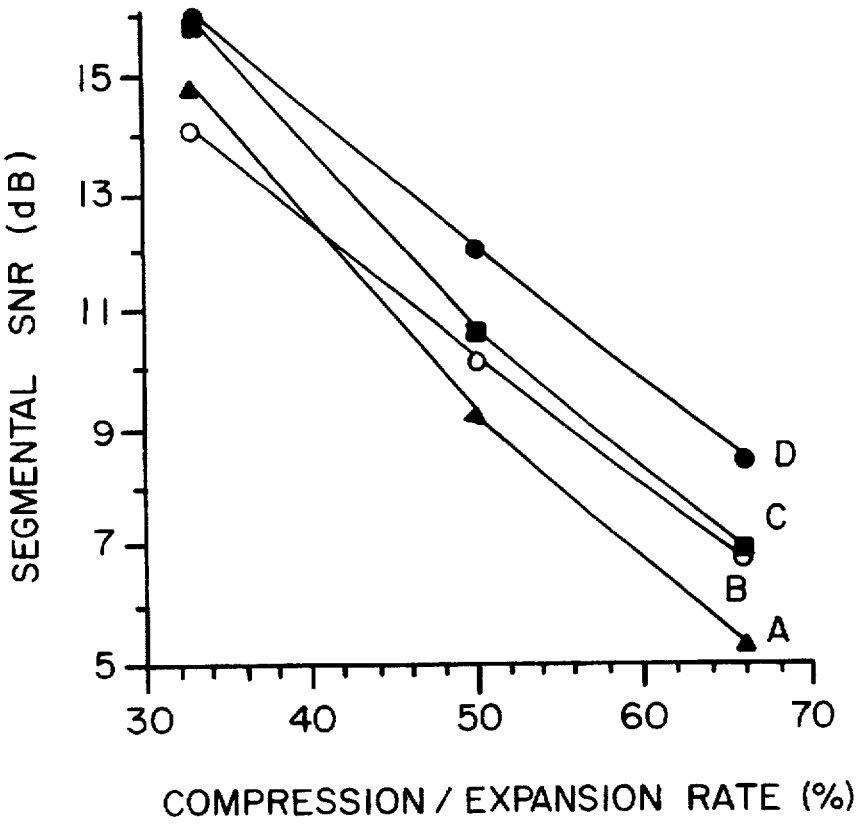
FIG. 20 is a graph showing a relationship between a segmental S/N ratio and a compression/expansion rate according to the embodiment of the present invention in comparing with that of the prior art PICOLA system.

An S/N ratio in a case where the compression process is performed according to the flowchart shown in FIG. 16 and the expansion process is performed in accordance with the flowchart shown in FIG. 12 is shown in FIG. 19 and FIG. 20 with comparing with that of the prior art PICOLA system (FIG. 3 and FIG. 7). In FIG. 19 and FIG. 20, lines A and B respectively show a male voice and a female voice in the PICOLA system, and lines C and D respectively show a male voice and a female voice in the above described embodiment. As seen from FIG. 19 and 20, according to the embodiment of the present invention, the S/N ratio is improved in comparison with the prior art PICOLA system.

In addition, in the above described embodiments (FIG. 12 and FIG. 16), the sound waveform segment having the length of XT is cut-out; however, the length of the waveform segment being cut-out may be, in general, NT (N is an integer larger than 2) or MT (M is an integer larger than 2). Then, N may be equal to A, but N may be not equal to M. As a result of an experimentation by the inventors, a sound quality is good in $N<M$ in comparison with a sound quality in $N>M$.

Furthermore, in the step S53 shown in FIG. 12, it is determined whether or not the expansion rate $rs \leqq 2$; however, if a length of the sound waveform segment being cut-out is NT, it is desirable that the determination condition in the step S53 is suitably changed according to $rs \leqq N/(N-1)$. Furthermore, in the step S73 shown in FIG. 16, it is determined whether or not the compression rate $rc \geqq ⅔$; however, if the length of the sound waveform segment being cut-out is MT, it is desirable that the determination condition in the step S73 is suitable changed according to $rc \geqq M/(M+1)$.

In actual, the length is preferably within a range of 2T–4T. If the length of the sound waveform segment is too long, the sound level and the pitch period are changed in the sound waveform segment, and therefore, the waveform distortion conversely becomes large.

Furthermore, in the above described embodiment, in a case where only a portion of the produced sound waveform segment is outputted as it is, a remaining portion of the produced sound waveform segment is returned to the input to obtain the continuity of the sound waveform; however, the above described remaining portion of the produced sound waveform segment may be discarded. In such a case, since the input sound waveform segment is utilized as an output sound waveform segment by which a preceding output sound waveform segment is followed, the continuity of the waveform becomes to be sacrified, but the process become simple.

Although the present invention has been described and illustrated in detail, it in clearly understood that the same is by way of illustration and example only and is not to be taken by way of limitation, the spirit and scope of the present invention being limited only by the terms of the appended claims.

What is claimed is:

1. A compression/expansion method for a time-scale of a sound signal, comprising:

a compression process (A) including the steps of (a-1) cutting-out two sound waveform segments each having a length that is a single pitch period irrespective of a compression rate from an input sound signal with one of said segments commencing at a first time point represented by a current pointer and the other of said two segments commencing at a second time point advanced from the first time point by the single pitch period, respectively, (a-2) producing a single sound waveform segment that is obtained through compression of the two sound waveform segments by adding the two sound waveform segments to each other with suitable weights, (a-3) moving the pointer to a fifth time point according to a compression rate, and outputting an input sound waveform segment from a time point advanced from the second time point by the single pitch period to the fifth time point as it is, the sound waveform segment produced in the step (a-2) being followed by the input sound waveform segment, or (a-4) moving the pointer to a fifth time point according to the compression rate, and outputting a portion of the waveform segment produced in the step (a-2) as it is, and (a-5) repeating the steps (a-1)–(a-3) or the steps (a-1), (a-2) and (a-4) as necessary; and an expansion process (B) including the steps of (b-1) receiving the sound waveform being compressed by the compression process (A) as an input sound signal, (b-2) cutting-out two sound waveform segments each having a length that is N times (N is an integer more than 2) the single pitch period irrespective of an expansion rate from the input sound signal with one of said two segments commencing at a third time point represented by the current pointer and the other of said two segments commencing at a fourth time point delayed from the third time point by the single pitch period, respectively, (b-3) producing a single synthesized sound waveform segment that is obtained through synthesization of the two sound waveform segments by adding the two sound waveform segments to each other after each is weighted in an opposite manner over the duration of each segment, (b-4) moving the pointer to a sixth time point and in response to an expansion rate equal to or below a first value, outputting an input sound waveform segment from a time point advanced from the third time point by (N−1) times the single pitch period to the sixth time point as it is, the sound waveform segment produced in the step (b-3) being followed by the input sound waveform segment, or (b-5) in response to the expansion rate being greater than said first value moving the pointer to a sixth time point and outputting a portion of the waveform segment, produced in the step (b-3) as it is, and (b-6) repeating the steps (b-2)–(b-4) or the steps (b-2), (b-3) and (b-5) as necessary.

2. A compression/expansion method for a time-scale of a sound signal, comprising:

a compression process (A) including the steps of (a-1) cutting-out two sound waveform segments each having a length that is N times (N is an integer more than 2) a single pitch period irrespective of a compression rate from an input sound signal with one of said two segments commencing at a first time point represented by a current pointer and the other of said two segments commencing at a second time point advanced from the first time point by the single pitch period, respectively, (a-2) producing a single sound waveform segment that is obtained through compression of the two sound waveform segments by adding the two sound waveform segments to each other after each is weighted in an opposite manner over the direction of the respective segments, (a-3) moving the pointer to a fifth time point and in response to a compression rate equal to or greater than a first value, outputting an input sound waveform segment from a time point advanced from the second time point by N times the pitch period to the fifth time point as it is, the sound waveform segment produced in the step (a-2) being followed by the input sound waveform segment, or (a-4) moving the pointer to the fifth time point in response to the compression rate being less than said first value and outputting a portion of the waveform segment produced in the step (a-2) as it is, and (a-5) repeating the steps (a-1)–(a-3) or the steps (a-1), (a-2) and (a-4) as necessary; and an expansion process (B) including the steps of (b-1) receiving the sound waveform being compressed by the compression process (A) as an input sound signal, (b-2) cutting-out two sound waveform segments each having a length that is M times (M is an integer more than 2) the single pitch period irrespective of an expansion rate from the input sound signal with one of said two segments commencing at a third time point represented by the current pointer and the other of said two segments commencing at a fourth time point delayed from the third time point by the single pitch period, respectively, (b-3) producing a single synthesized sound waveform segment that is obtained through synthesization of the two sound waveform segments by adding the two sound waveform segments to each other after each is weighted in an opposite manner over the duration of each segment, (b-4) moving the pointer to a sixth time point and in response to an expansion rate equal to or below a first value, outputting an input sound waveform segment from a time point advanced from the third time point by (M−1) times the pitch period to the sixth time point as it is, the sound waveform segment produced in the step (b-3) being followed by the input sound waveform segment, or (b-5) in response to the expansion rate being greater than said first value moving the pointer to a sixth time point and outputting a portion of the waveform segment, produced in the step (b-3) as it is, and (b-6) repeating the steps (b-2)–(b-4) or the steps (b-2), (b-3) and (b-5) as necessary.

3. A method according to claim 2, wherein said N is equal to said M.

4. A method according to claim 2, wherein said N is different from said M.

5. A method according to claim 2, wherein said N is smaller than said M.

6. A compression method for a time-scale of a sound signal, comprising the steps of:

(a-1) cutting-out two sound waveform segments each having a length that is N times (N is an integer more than 2) a single pitch period irrespective of a compression rate from an input sound signal with one of said two segments commencing at a first time point represented by a current pointer and the other of said two segments commencing at a second time point advanced from the first time point by the single pitch period, respectively, (a-2) producing a single sound waveform segment that is obtained through compression of the two sound waveform segments by adding the two sound waveform segments to each other after each is weighted in an opposite manner over the direction of the respective segments, (a-3) moving the pointer to a fifth time point and in response to a compression rate equal to or greater than a first value, outputting an input sound waveform segment from a time point advanced from the second time point by N times the pitch period to the fifth time point as it is, the sound waveform segment produced in the step (a-2) being followed by the input sound waveform segment, or p1 (a-4) moving the pointer to the fifth time point in response to the compression rate being less than said first value and outputting a portion of the waveform segment produced in the step (a-2) as it is, and (a-5) repeating the steps (a-1)–(a-3) or the steps (a-1), (a-2) and (a-4) as necessary.

7. An expansion method of a time-scale of an input sound signal, comprising the steps of:

(b-1) cutting-out two sound waveform segments each having a length that is N times (N is an integer more than 2) the single pitch period irrespective of an expansion rate from the input sound signal with one of said two segments commencing at a third time point represented by the current pointer and the other of said two segments commencing at a fourth time point delayed from the third time point by the single pitch period, respectively, (b-2) producing a single synthesized sound waveform segment that is obtained through synthesization of the two sound waveform segments by adding the two sound waveform segments to each other after each is weighted in an opposite manner over the duration of each segment, (b-3) moving the pointer to a sixth time point and in response to an expansion rate equal to or below a first value outputting an input sound waveform segment from a time point advanced from the third time point by (N−1) times the pitch period to the sixth time point as it is, the sound waveform segment produced in the step (b-2) being followed by the input sound waveform segment, or (b-4) in response to the expansion rate being greater than said first value moving the pointer to a sixth time point and outputting a portion of the waveform segment, produced in the step (b-2) as it is, and (b-5) repeating the steps (b-2)–(b-3) or the steps (b-1), (b-2) and (b-4) as necessary.

* * * * *